US010190414B2

(12) United States Patent
Gitelis

(10) Patent No.: US 10,190,414 B2
(45) Date of Patent: Jan. 29, 2019

(54) ROUND INTERNAL COMBUSTION ENGINE

(71) Applicant: Asaf Gitelis, Moshav Bnei Atarot (IL)

(72) Inventor: Asaf Gitelis, Moshav Bnei Atarot (IL)

( * ) Notice: Subject to any disclaimer, the term of this patent is extended or adjusted under 35 U.S.C. 154(b) by 44 days.

(21) Appl. No.: 15/633,814

(22) Filed: Jun. 27, 2017

(65) Prior Publication Data

US 2017/0292443 A1 Oct. 12, 2017

Related U.S. Application Data

(63) Continuation-in-part of application No. 14/520,363, filed on Oct. 22, 2014, now abandoned.

(51) Int. Cl.

| | |
|---|---|
| ***F01C 1/07*** | (2006.01) |
| ***F01C 1/077*** | (2006.01) |
| ***F02B 55/02*** | (2006.01) |
| ***F02B 55/08*** | (2006.01) |
| ***F02B 55/14*** | (2006.01) |

(52) U.S. Cl.

CPC ..... *F01C 1/07* (2013.01); *F01C 1/077* (2013.01); *F02B 55/02* (2013.01); *F02B 55/08* (2013.01); *F02B 55/14* (2013.01)

(58) Field of Classification Search

CPC .. F02B 55/02; F02B 55/08; F01C 1/07; F01C 1/077

See application file for complete search history.

(56) References Cited

U.S. PATENT DOCUMENTS 2,899,944 A * 8/1959 Patkau ..... F01C 1/07 418/37
3,753,630 A * 8/1973 Sadahiro ..... F01C 1/07 418/36
3,890,939 A * 6/1975 McIntosh ..... F01C 1/07 418/36
3,990,405 A * 11/1976 Kecik ..... F01C 1/063 123/219
2006/0150949 A1* 7/2006 Kovalenko ..... F01C 1/07 123/241
2008/0251043 A1* 10/2008 Li ..... F01C 1/077 123/184.21

FOREIGN PATENT DOCUMENTS

JP 2001336402 A * 12/2001

* cited by examiner

*Primary Examiner* — Daniel J Colilla

(74) *Attorney, Agent, or Firm* — Daniel J. Swirsky; AlphaPatent Associates Ltd.

(57) ABSTRACT

A round internal combustion engine (10) comprising: a stationary toroidal combustion chamber (44); a first (24A) and a second (24B) shaft member, each for connecting thereof to at least one piston (26A1, 26A2, 26B1, 26B2) disposed within the stationary toroidal combustion chamber (44); and a positioning mechanism (60), for changing angular positioning and velocity between the first (24A) and second (24B) shaft members, for increasing and decreasing a distance between the pistons (26A1, 26A2, 26B1, 26B2) of the shaft members (24A, 24B), the positioning mechanism (60) comprising: at least one rotatable wheel (28*i*, 28*ii*, 28*iii*) disposed eccentrically (58) within the first shaft member (24A); and at least one rotatable connecting-rod (56*i*, 56*ii*, 56*iii*) disposed between the first (24A) and second (24B) shaft members, for directly connecting an eccentric anchor (36A) of the at least one rotatable wheel (28*i*, 28*ii*) to an eccentric anchor (36B) of the second shaft member (24B).

11 Claims, 20 Drawing Sheets

ROUND INTERNAL COMBUSTION ENGINE

CROSS-REFERENCE TO RELATED APPLICATIONS

This application is a continuation-in-part of U.S. patent application Ser. No. 14/520,363, filed Oct. 22, 2014.

TECHNICAL FIELD

The present invention relates to the field of round internal combustion engines. More particularly, the invention relates to a round internal combustion engine having reduced mechanical complications.

BACKGROUND

The article entitled Toroidal Internal-Combustion Engines (toroidalIC.htm) found at aqpl43.dsl.pipex.com criticizes the toroidal internal-combustion engines approach.

Several inventors have persuaded themselves that having curved pistons oscillating or rotating inside a cylinder block is a good idea. It is not. Here is the story of the toroidal internal-combustion engines.

An engine expert speaks:

"A great many ideas for engines in which toroidal pistons rotate or reciprocate within toroidal cylinders have been advanced. The difficulties of connecting such pistons to the output shaft by a simple and reliable mechanism, together with the problem of sealing the surfaces involved, make such ideas little more than amusing adventures in ingenuity."

Left: The Bradshaw Omega engine: 1955.

THE TSCHUDI ENGINE: 1967

Originator: Traugott Tschudi (Swiss). Work began on the engine in 1927. U.S. Pat. No. 3,381,669; May 1968 . . . An obvious objection to this design is that the stresses on the rollers and cams are going to be very high.

Bill Todd says:

"The cam is at a considerable mechanical disadvantage, so both it and the follower rollers are under enormous stress. The patent drawing shows the follower/roller assembly spring mounted to the rotor to 'decease friction and ware', presumably because Tschudi couldn't get the cam shape quite right."

Research into the history of the Tschudi engine has so far yielded very little. It does not seem to have made any news since 1968. Given the painfully obvious mechanical problems and the absence of any advantages, it seems unlikely that Tschudi found any financial backing.

Left: The Morgado engine.

The operating principle is similar to that of the Bradshaw engine above, but in this case the pistons in the toroid move back and forth in conjunction with a rotating crank and connecting-rod assembly.

The Morgado engine is covered by U.S. Pat. No. 6,739,307 . . .

The stresses are produced by mighty direct force of the internal combustion between the opposing pistons, absorbed by indirect couplings and gears, coordinating the motions to be produced from said forces.

The above mentioned publications disclose two separate modules, the first is the toroidal combustion chamber containing the opposing pistons; and the second module receives two axles from the first module, one from each piston, and mechanically coordinates the motions to be produced from said forces.

U.S. Pat. No. 7,255,086 to Kovalenko attempts to reduce the mechanical chain by disclosing a structure in which the mechanical module is disposed within the main housing.

However, Kovalenko too discloses indirect forces between the opposing pistons. The opposing pistons of kovalenko are enumerated 5 and 6. Referring to FIG. 5, Kovalenko reads:

Here, piston 6 together with bearing member 16 rotates clockwise. Coupler link 73 turns eccentric member 30 clockwise, and as a result satellite gear 26, while rotating about its axis, is rolling clockwise together with main journal 34 about gearwheel 22; here, main journal 34, by acting upon the wall of the opening provided in ring 66 of flywheel 14, rotates said flywheel clockwise. At the same time, under the effect of the pressure exerted by combustion gases, piston 5 with bearing member 17 rotates counter-clockwise. Coupler link 70 rotates eccentric member 29 together with satellite gear 25 clockwise. Similarly to satellite gear 26, satellite gear 25, while rotating about its axis, is rolling clockwise together with main journal 33 of eccentric member 29 about gearwheel 23, main journal 33 also rotating flywheel 14 clockwise. Thus, pistons 6 and 5 transfer clockwise-directed torques, i.e. an overall torque, to flywheel 14.

According to this paragraph of Kovalenko, each of the opposing pistons 5 and 6, is meshed (through a gear) to a corresponding satellite gear, namely piston 5 is meshed to satellite gear 26, and piston 6 is meshed to satellite gear 25, wherein both satellite gears 25 and 26 roll the same flywheel 14, providing the output shaft 13, and wherein gears 25 and 26 are connected one to the other through a communicating mechanism.

Thus force transfer from one piston to the other, as disclosed by Kovalenko is: from piston 6 to satellite gear 26, then to stationary gear 22, then to satellite gear 25, and then to the opposing piston 5.

Each of pistons 5 and 6 is connected to the corresponding satellite gears, being 25 and 26 respectively, through corresponding coupler links, being 70 and 73 respectively, for communicating the motion between the pistons.

Thus, pistons 5 and 6 of Kovalenko, having rapid changing of velocity therebetween, communicate through meshing of gears, being non-durable components.

The above-mentioned numerals refer to U.S. Pat. No. 7,255,086 to Kovalenko only and to the figures thereof. The above-mentioned numerals do not refer, neither to any drawing of the application, nor to any numeral in the following description. The detailed description might use equal numerals, however for different components.

All the methods described above have not yet provided satisfactory solutions to the problem of indirect connection between the pistons.

It is an object of the present invention to provide a method and apparatus providing direct connection between the pistons.

Another disadvantage of Kovalenko and others is in that the flywheel is shared by both pistons.

"A flywheel is a rotating mechanical device that is used to store rotational energy. Flywheels have a significant moment of inertia and thus resist changes in rotational speed. The amount of energy stored in a flywheel is proportional to the square of its rotational speed. Energy is transferred to a flywheel by applying torque to it, thereby increasing its rotational speed, and hence its stored energy. Conversely, a flywheel releases stored energy by applying torque to a mechanical load, thereby decreasing its rotational speed.

Flywheels are often used to provide continuous energy in systems where the energy source is not continuous. In such cases, the flywheel stores energy when torque is applied by the energy source, and it releases stored energy when the energy source is not applying torque to it. For example, a flywheel is used to maintain constant angular velocity of the crankshaft in a reciprocating engine. In this case, the flywheel—which is mounted on the crankshaft—stores energy when torque is exerted on it by a firing piston, and it releases energy to its mechanical loads when no piston is exerting torque on it." (from the article "Flywheel" at Wikipedia.org—emphasis added)

The basic ambition of toroidal internal-combustion engines is to provide a constant angular velocity of the output shaft ("crankshaft"), together with providing differentiation of the angular velocity of one piston in relation to the other. This means that one of the pistons is to be fixed to the output shaft.

In contrast to this basic ambition, Kovalenko disclosing the force transfer from piston 6 to satellite gear 26, then to stationary gear 22, then to satellite gear 25, and then to the opposing piston 5, shares the same flywheel to both pistons, meaning that both flywheels change the angular velocity.

Thus, it is another object of the present invention to provide a method and apparatus providing constant angular velocity of the output shaft, together with providing differentiation of the angular velocity of one piston in relation to the other.

It is an object of the present invention to provide a solution to the above-mentioned and other problems of the prior art.

Other objects and advantages of the invention will become apparent as the description proceeds.

SUMMARY

A round internal combustion engine (10) comprising:

a stationary toroidal combustion chamber (44);

a first (24A) and a second (24B) shaft member, each for connecting thereof to at least one piston (26A1, 26A2, 26B1, 26B2) disposed within the stationary toroidal combustion chamber (44); and a positioning mechanism (60), for changing angular positioning and velocity between the first (24A) and second (24B) shaft members, for increasing and decreasing a distance between the pistons (26A1, 26A2, 26B1, 26B2) of the shaft members (24A, 24B), the positioning mechanism (60) comprising:

a) at least one rotatable wheel (28*i*, 28*ii*, 28*iii*) disposed eccentrically (58) within the first shaft member (24A); and b) at least one rotatable connecting-rod (56*i*, 56*ii*, 56*iii*) disposed between the first (24A) and second (24B) shaft members, for directly connecting an eccentric anchor (36A) of the at least one rotatable wheel (28*i*, 28*ii*, 28*iii*) to an eccentric anchor (36B) of the second shaft member (24B), thereby stresses between the first (24A) and second (24B) shaft members, applied by the changing of the angular positioning and of the angular velocity between the first (24A) and second (24B) shaft members, are absorbed by the at least one rotatable connecting-rod (56*i*, 56*ii*, 56*iii*) rather than by gear meshing.

One of the shaft members (24A, 24B) may comprise significantly larger mass that the other shaft member (24A, 24B), thereby the angular velocity of that shaft members (24A, 24B) is substantially constant, and the angular velocity of the other shaft member (24A, 24B) is conveniently changeable by the changing of the angular positioning and of the angular velocity between the first (24A) and second (24B) shaft members.

The round internal combustion engine (10) may further comprise:

a springy element (84A, 84B), for connecting at least one of the shaft members (24A, 24B) to the piston (26A1, 26A2, 26B1, 26B2) thereof, thereby softening momentary forces of the shaft members (24A, 24B) one upon the other.

The shaft member (24A, 24B) comprising the larger mass may comprise the first shaft member (24A), thereby utilizing the at least one rotatable wheel (28*i*, 28*ii*, 28*iii*) for enlarging the mass.

The at least one rotatable wheel (28*i*, 28*ii*, 28*iii*) may comprise at least one gear, and the round internal combustion engine (10) may further comprise:

a stationary gear (20) meshed with the at least one rotatable wheel (28*i*, 28*ii*, 28*iii*), for rotating the at least one rotatable wheel (28*i*, 28*ii*, 28*iii*) about itself upon the rotation of the first shaft member (24A).

The at least one gear (28*i*, 28*ii*, 28*iii*) being meshed with the stationary gear (20), may comprise:

a first secondary gear (28*i*A) meshed with the stationary gear (20);

a second secondary gear (28*i*A) meshed the stationary gear (20); and a spring (106) disposed between the first (28*i*A) and second (28*i*B) secondary gears, for angularly pressing one secondary gear against the other, thereby the spring (106) presses each cog (112A) of the first secondary gear (28*i*A) towards one side (116A) of a meshed cog of the stationary gear (20), and presses each cog (112B) of the second secondary gear (28*i*B) towards a counter side (116B) of the meshed cog of the stationary gear (20), thereby the spring (106) substantially avoids knocking of the cogs one against the other, in spite of the changing of the angular velocity between the first (24A) and second (24B) shaft members.

The stationary toroidal combustion chamber (44) may comprise a combustion aperture (38) disposed where (80) the distance between the at least one piston (26A1, 26A2, 26B1, 26B2) of the first (24A) and of second (24B) shaft member is substantially minimal.

At a position that the distance between the at least one piston (26A1, 26A2, 26B1, 26B2) of the first (24A) and of second (24B) shaft member is minimal (80), the positioning mechanism (60) is characterized in braking one of the shaft member (24B) against pressure applied by combustion on the piston thereof (26B1) against (76B) the advancement direction (76A).

The character of the positioning mechanism of braking one of the shaft members (24B) against the pressure applied by the combustion on the piston thereof (26B1) against (76B) the advancement direction (76A), may comprise:

disposition of the at least one rotatable connecting-rod (56*i*, 56*ii*, 56*iii*) being directed substantially towards a center (86A) of the at least one rotatable wheel (28*i*, 28*ii*, 28*iii*) at the position that the distance between the at least one piston (26A1, 26A2, 26B1, 26B2) of the first (24A) and of second (24B) shaft member is substantially minimal (80), thereby pressure applied by the combustion towards the advancement direction (76A) presses the at least one rotatable connecting-rod (56*i*, 56*ii*, 56*iii*) perpendicular thereto, and pressure applied by the combustion against (76B) the advancement direction (76A) presses the at least one rotatable connecting-rod (56*i*, 56*ii*, 56*iii*) parallel thereto.

The stationary gear (20) may comprise a peripheral gear (20), for allowing the at least one rotatable wheel (28*i*, 28*ii*, 28*iii*) rotate inside the stationary gear (20).

According to another embodiment, the stationary gear (20) may comprise a wheel, for allowing the at least one rotatable wheel (28*i*, 28*ii*, 28*iii*) rotate outside the stationary gear (20).

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

BRIEF DESCRIPTION OF THE DRAWINGS

Embodiments, features, and aspects of the invention are described herein in conjunction with the following drawings.

It should be understood that the drawings are not necessarily drawn to scale.

DETAILED DESCRIPTION

The invention will be understood from the following detailed description of embodiments which are meant to be descriptive and not limiting. For the sake of brevity, some well-known features, methods, systems, procedures, components, circuits, and so on, are not described in detail.

Figure 1:
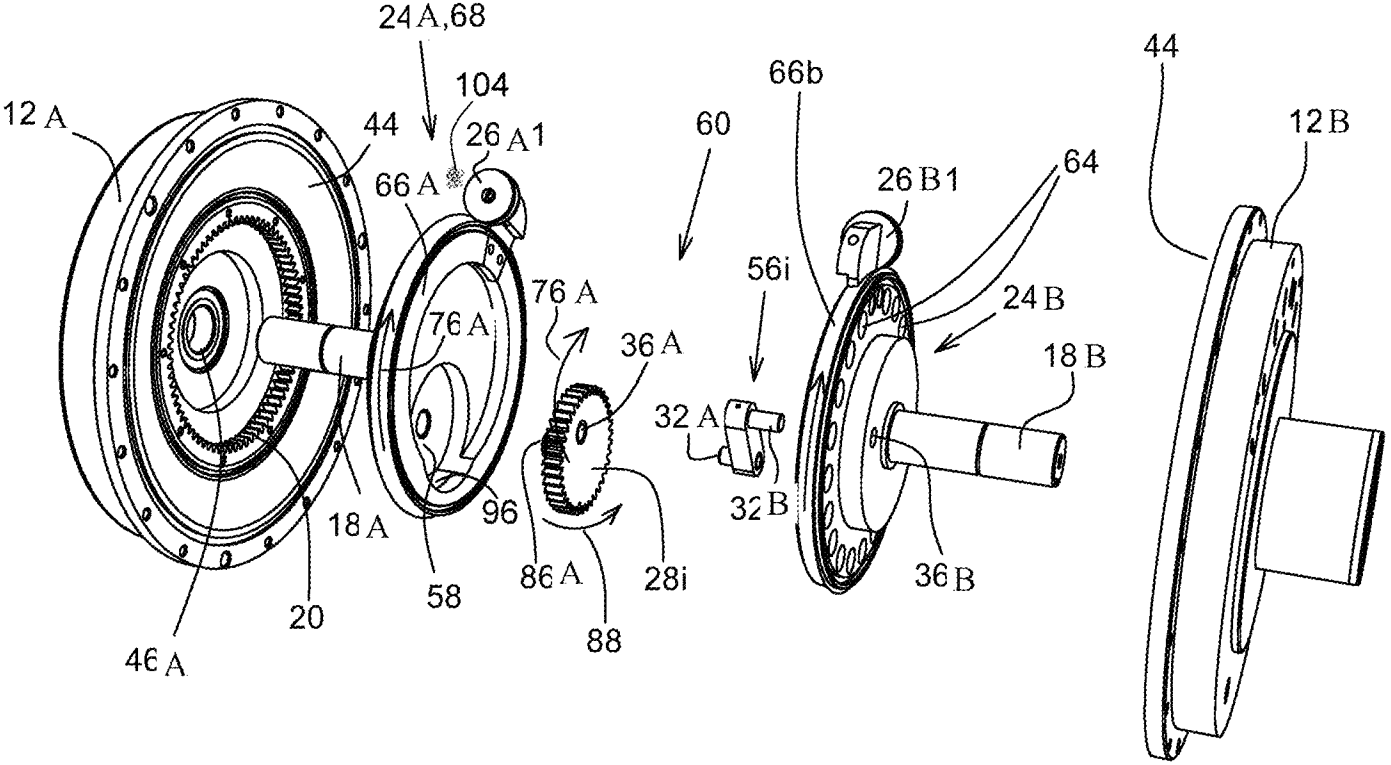
FIG. 1 is an exploded view of a round internal combustion engine, according to a simplified embodiment of the present invention.

FIG. 1 is an exploded view of a round internal combustion engine, according to a simplified embodiment of the present invention.

A round internal combustion engine 10 includes two stationary housing members 12A and 12B, forming together a toroidal combustion chamber 44 in between. Two shaft members, namely 24A and 24B, rotate within and between stationary housing members 12A and 12B.

Shaft member 24A includes a ring 66A, and shaft member 24B includes a ring 66B, the rings for completing the sealing of the internal portion of toroidal combustion chamber 44.

The shaft member which includes the output shaft is designed to constitute a flywheel enumerated 68. The output shaft may be determined to be 18A, determining shaft member 24A to be the flywheel 68. Thus, shaft member 24B is to be designed to be relatively heavy, whereas shaft member 24B is to be designed to be lightweight, as demonstrated by a plurality of holes 64 in shaft member 24B occupying a significant area thereof.

At least one piston is connected to each shaft member. According to the simplified embodiment of FIG. 1, piston 26A1 is connected to shaft member 24A being the flywheel according to the example; and piston 26B1 is connected to shaft member 24B. Piston 26A1 extends out of ring 66A, and piston 26B1 extends out of ring 66B, thus pistons 26A1 and 26B1 are disposed within toroidal combustion chamber 44 and are movable therewithin.

Round internal combustion engine 10 further includes a positioning mechanism 60, disposed between shaft members 24A and 24B, for determining the rotary position between the shaft members, and thus between piston 26A1 and 26B1, through connection between shaft members 24A and 24B.

The terms "direct connection" and "directly" refer herein substantially to the reduction of intervening components, to the lack of gears, and also to the reduction of reciprocal motion between the pistons.

The connection between shaft members 24A and 24B is substantially direct, since there is no meshing of gears therebetween, thus positioning mechanism 60 is herein named "direct positioning mechanism".

Positioning mechanism 60 includes one or more connecting-rods 56*i*, for connecting at least one eccentric anchor 36B of shaft member 24B with an eccentric area 58 of shaft member 24A.

The simplified embodiment of FIG. 1 includes only one connecting-rod 56*i*, for connecting eccentric anchor 36B of shaft member 24B with the eccentric area 58 of shaft member 24A.

Connecting-rod 56*i* allows one of the shaft members to directly pull the other shaft member thereafter, for making one piston directly follow the other piston. In the example of FIG. 1, connecting-rod 56*i* allows shaft member 24A to directly pull shaft member 24B thereafter, for making piston 26B1 directly follow piston 26A1.

At least one wheel 28*i* is disposed within at least one eccentric area 58 of shaft member 24A. Wheel 28*i* includes an eccentric anchor 36A. An end 32A of connecting-rod 56*i* is anchored to eccentric anchor 36A of wheel 28*i* within shaft member 24A; and another end 32B of connecting-rod 56*i* is anchored to anchor 36B of shaft member 24B.

Thus, connecting-rod 56*i* connects eccentric anchor 36A of shaft member 24A with eccentric anchor 36B (within eccentric area 58) of shaft member 24B. The connection between shaft member 24A and shaft member 24B via connecting-rod 56*i* allows free rotation of connecting-rod 56*i* in relation to any of shaft members 24A and 24B.

Wheel 28*i* constitutes a gear 28*i*, being meshed with a stationary gear 20, which is rigidly fixed to stationary housing member 12A.

Thus, upon rotation of shaft member 24A along direction 76A, being the advancement direction, by gas pressure applied on piston 26A1 at the Power Stroke, gear 28*i* rotates about the axle 86A thereof, to the opposite direction enumerated 88, further to being eccentrically carried by shaft member 24A along advancement direction 76A thereof.

Once gear 28*i* rotates about itself along direction 88, eccentric anchor 36A thereof changes the location thereof within eccentric area 58 of shaft member 24B. The trajectory of gear 28*i* and in particular of eccentric anchor 36A thereof is herein named "satellite trajectory", and thus gear 28*i* is herein named "satellite gear".

Satellite gear 28*i* determines the position of shaft member 24B, in relation to the stationary (static) components of the engine. However, gear 28*i* does not connect shaft member 24A to shaft member 24B, since connecting-rod 56*i* is which connects shaft member 24A to shaft member 24B.

Connecting-rod 56*i* makes shaft member 24A carry shaft member 24B through an eccentric trajectory of anchor 36A, and a simple round trajectory of anchor 36B.

Figure 2:
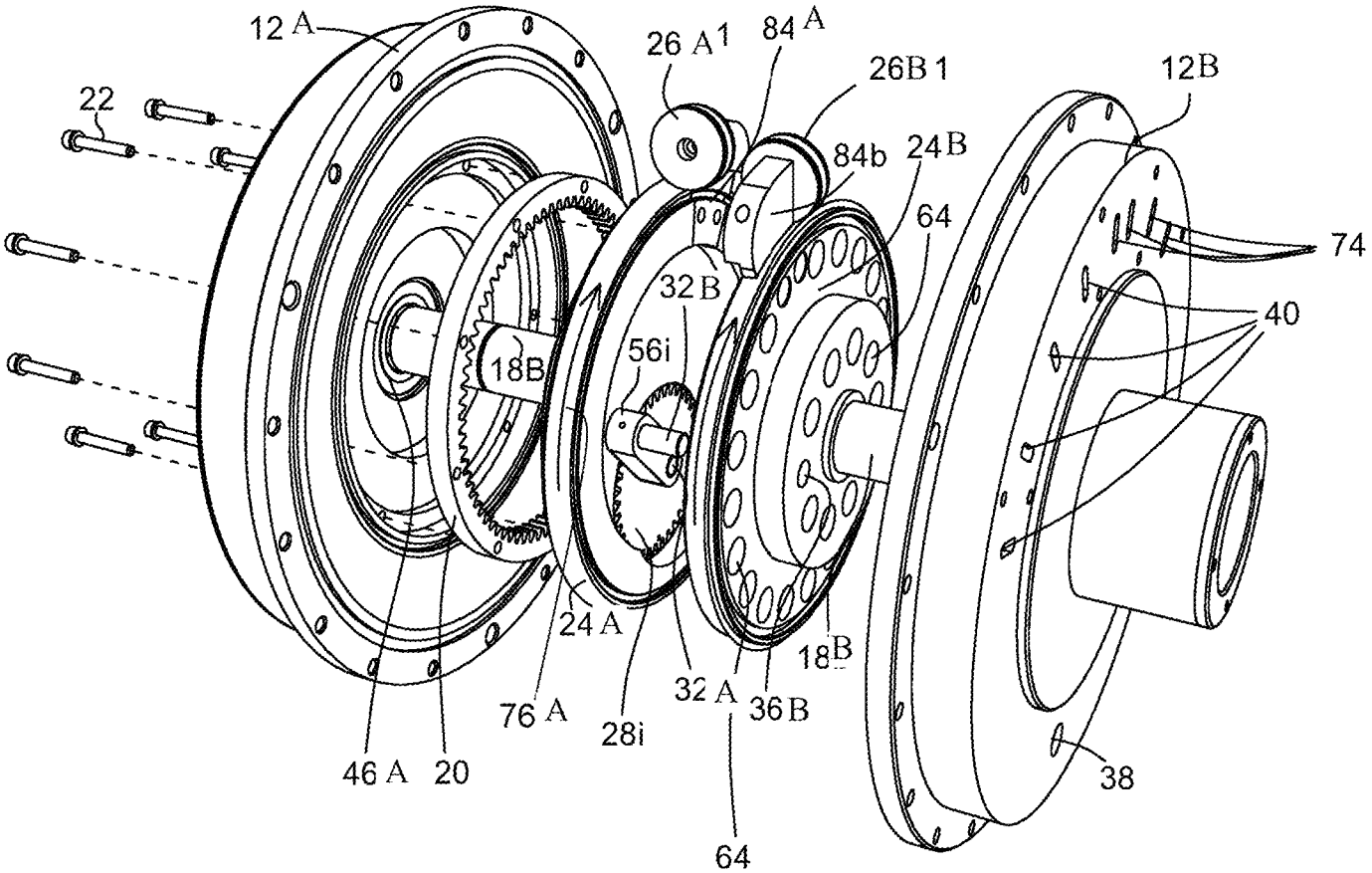
FIG. 2 is the exploded view of FIG. 1, showing the pistons one adjacent to the other.

FIG. 2 is the exploded view of FIG. 1, showing the pistons one adjacent to the other.

High-pressure gas, produced by combustion, confined between pistons 26A1 and 26B1, applies force, drawing them one away from the other. Upon applying the force on shaft members 24A and 24B, shaft member 24A including output shaft 18A, and constituting flywheel 68, tends to continue in a constant angular velocity, due to the inertia; whereas shaft member 24B, not being a flywheel, has no difficulty to change the angular velocity thereof. The meaning of no difficulty to change the angular velocity of shaft member 24B is that the change of the angular velocity of shaft member 24B does not apply significant forces on shaft member, even though shaft members 24A and 24B are connected one to the other via connecting-rod 56*i*.

In order to further soften the momentary forces of shaft members 24A and 24B one upon the other, applied by the combustion confined between pistons 26A1 and 26B1, piston 26A1 may be connected to shaft member 24A via a springy element 84A, and piston 26B1 may be connected to shaft member 24B via a springy element 84B.

Positioning mechanism 60 is designed to increase and decrease the angular velocity of shaft member 24B back and forth, for changing the distance between pistons 26A1 and 26B1.

According to one embodiment, stationary gear 20 is fixed to housing member 12B by bolts 22.

Any of housing elements 12A or 12B may include intake inlets 74, an ignition plug aperture 38, and exhaust outlets 40.

Figure 2A:
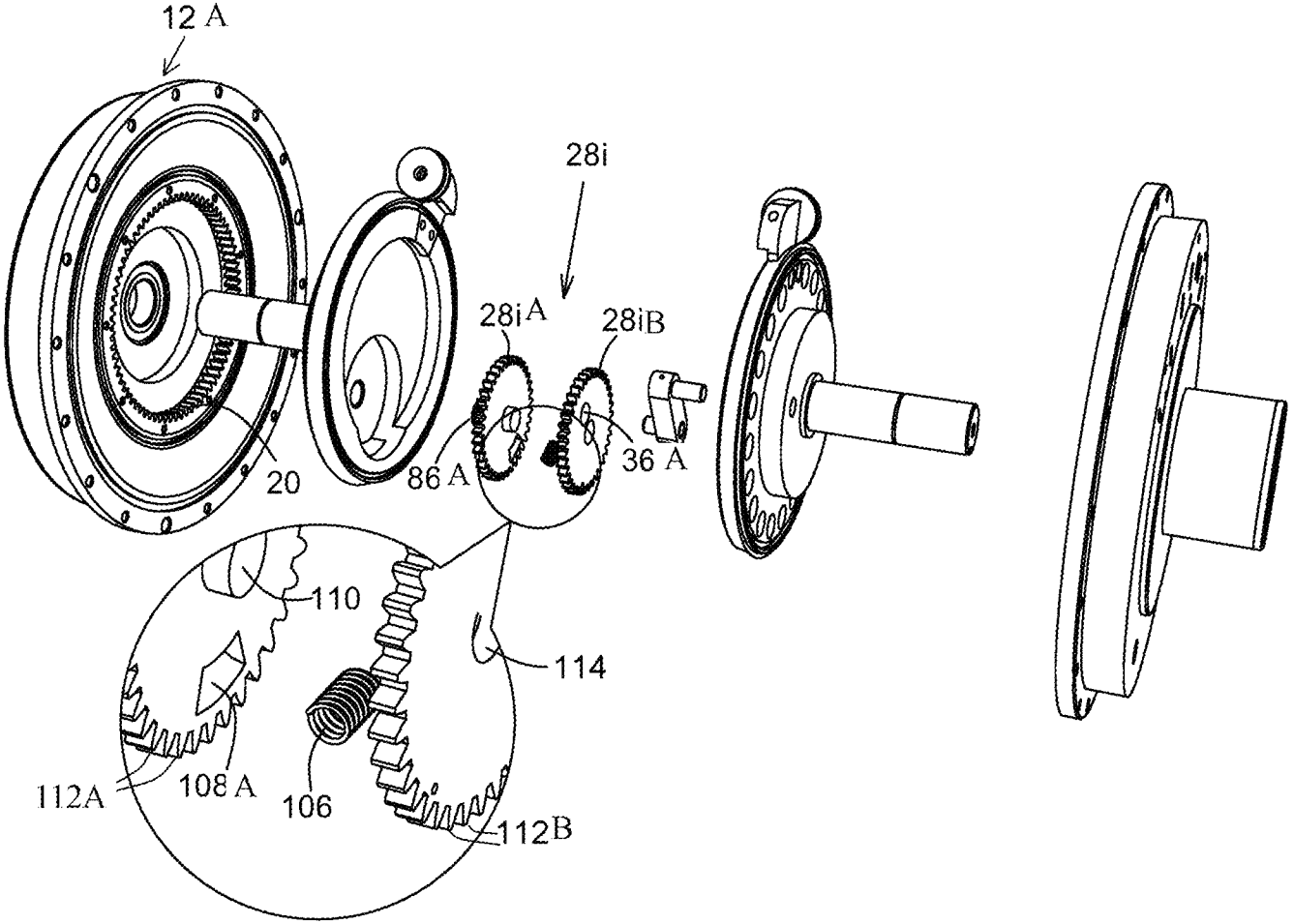
FIG. 2A is the exploded view of FIG. 1, except that the satellite gear of FIG. 1 constitutes two secondary gears.

FIG. 2A is the exploded view of FIG. 1, except that the satellite gear of FIG. 1 constitutes two secondary gears.

Figure 2B:
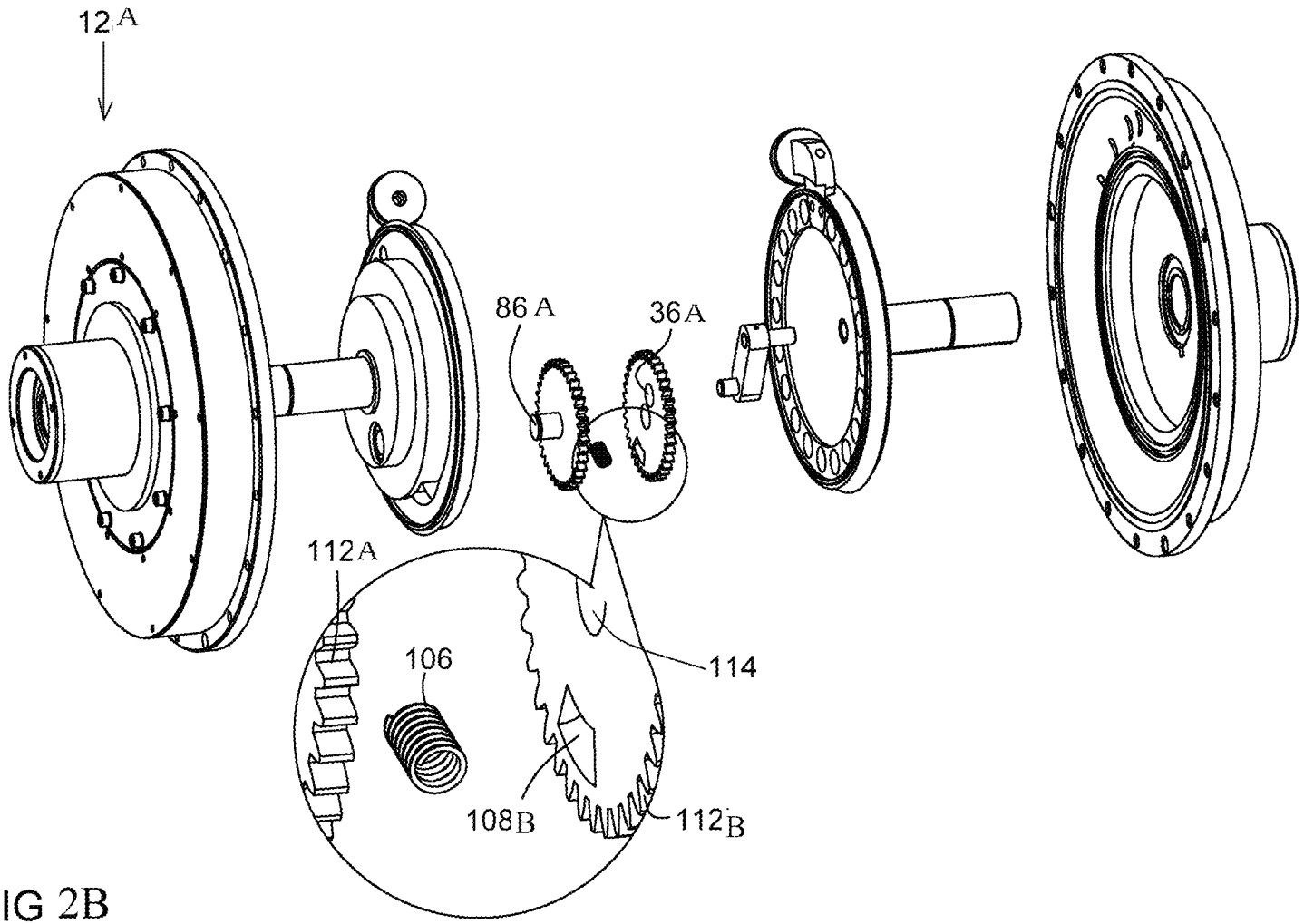
FIG. 2B is the exploded view of FIG. 2A, from another angle of view.

FIG. 2B is the exploded view of FIG. 2A, from another angle of view.

In order to further soften the momentary forces of shaft members 24A and 24B one upon the other, satellite gear 28*i* may be separated to two secondary gears, namely secondary gear 28*i*A includes axle 86A, and secondary gear 28*i*B includes eccentric anchor 36A.

Secondary gears 28*i*A and 28*i*B are pivotally connected one to the other by an axle 110 and a complementary niche 114, each of a different secondary gear.

A coupling element 106, for coupling secondary gears 28*i*A and 28*i*B one to the other, is disposed within a depression 108A of secondary gear 28*i*A, and also within a depression 108B of secondary gear 28*i*B. Coupling element 106 thus prevents free rotation of secondary gear 28*i*A in relation to secondary gear 28*i*B.

However coupling element 106 constitutes a spring, thus it allows a slight motion therebetween.

Figure 2D:
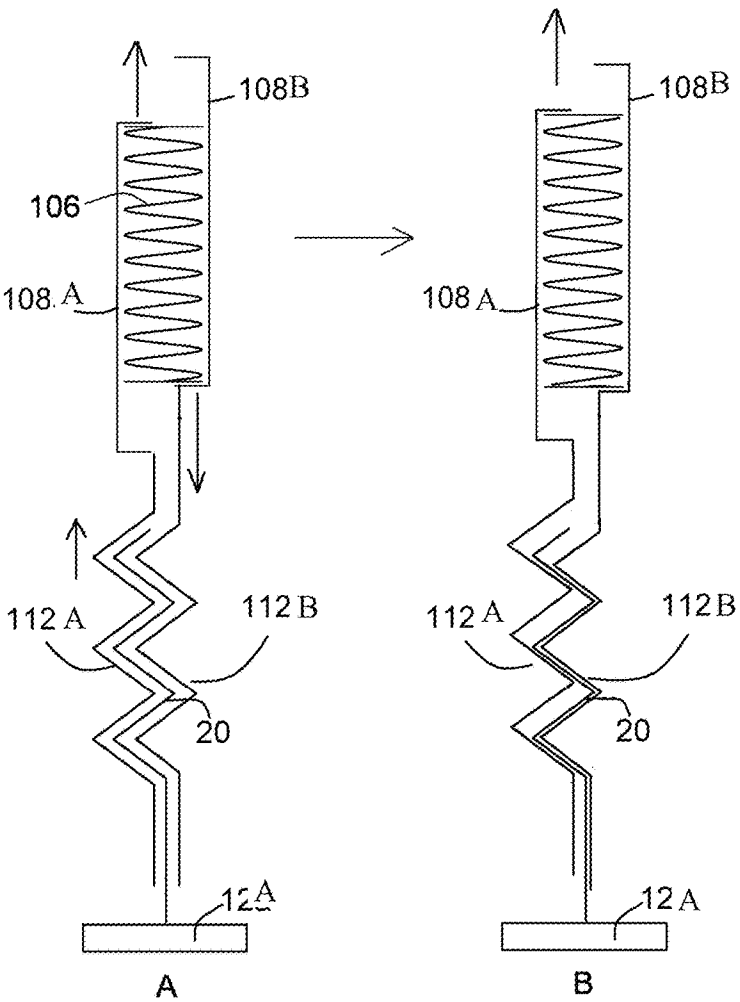
FIG. 2D is a principle illustration (not a real view), combining FIG. 2A and FIG. 2C.
Figure 2C:
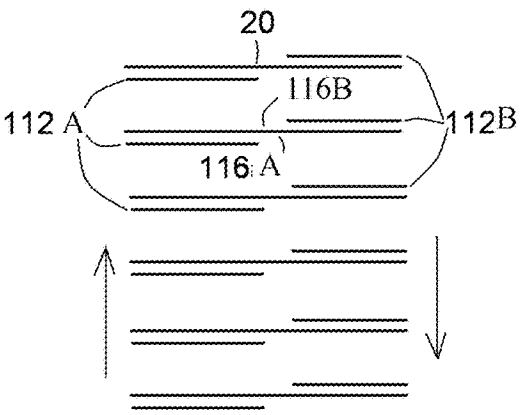
FIG. 2C is a top sectional view of the cogs of the secondary gears of FIGS. 2A and 2B, and of the cogs of the stationary gear 20.

FIG. 2C is a top sectional view of the cogs of the secondary gears of FIGS. 2A and 2B, and of the cogs of the stationary gear 20.

The problem to be solved by the separation of gear 28*i* to secondary gears secondary gears 28*i*A and 28*i*B, is that positioning mechanism 60 changes the rotational speed of motion between shaft members 24A and 24B, and the changes may move cogs of gear 28*i* back and forth in relation to cogs of stationary gear 20, thus knocking the cogs of gear 28*i* with the cogs of stationary gear 20, thus damaging these and those.

The solution for avoiding the knocking of the cogs for protecting the cogs is obtained by separating gear 28*i* to secondary gears 28*i*A and 28*i*B. Spring 106 pushes each cog 112A of secondary gear 28*i*A to one side, enumerated 116A, of the meshed cog of stationary gear 20, and pushes each cog 112B of secondary gear 28*i*B to the other side, enumerated 116B, of stationary gear 20.

FIG. 2D is a principle illustration (not a real view), combining FIG. 2A and FIG. 2C.

FIG. 2D illustrates three cogs of stationary gear 20, three cogs 112A of secondary gear 28*i*A, and three cogs 112B of secondary gear 28*i*B. FIG. 2D illustrates that cogs 112A are movable together with depression 108A of secondary gear 28*i*A, and that cogs 112B are movable together with depression 108B of secondary gear 28*i*B. Cogs of stationary gear 20 do not move, since stationary gear 20 is fixed to housing element 12A.

FIG. 2D illustrates that expanding spring 106 moves depression 108A and thus cogs 112A upwards, and moves depression 108B and thus cogs 112B downwards.

The motion of cogs 112A applied by spring 106 upwards, and as well the motion of cogs 112B downwards, are limited by stationary gear 20, as illustrated by position B, thus providing the position of FIG. 2C.

Figure 3:
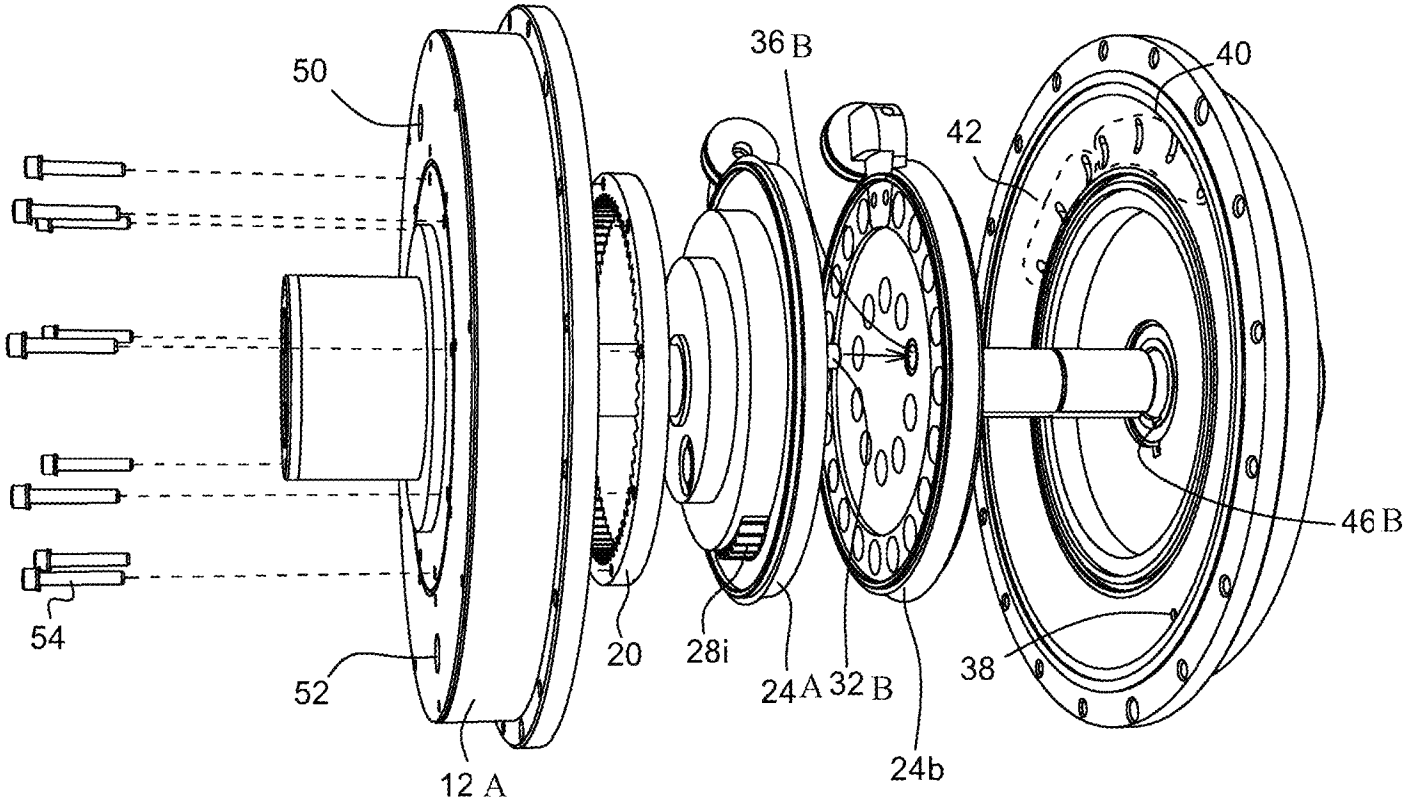
FIG. 3 is the exploded view of FIG. 2, from another angle of view.

FIG. 3 is the exploded view of FIG. 2, from another angle of view.

Satellite gear 28*i* of shaft member 24B is exposed to stationary gear 20 through an opening 96 of shaft member 24B, indicated in FIG. 1.

Figure 4:
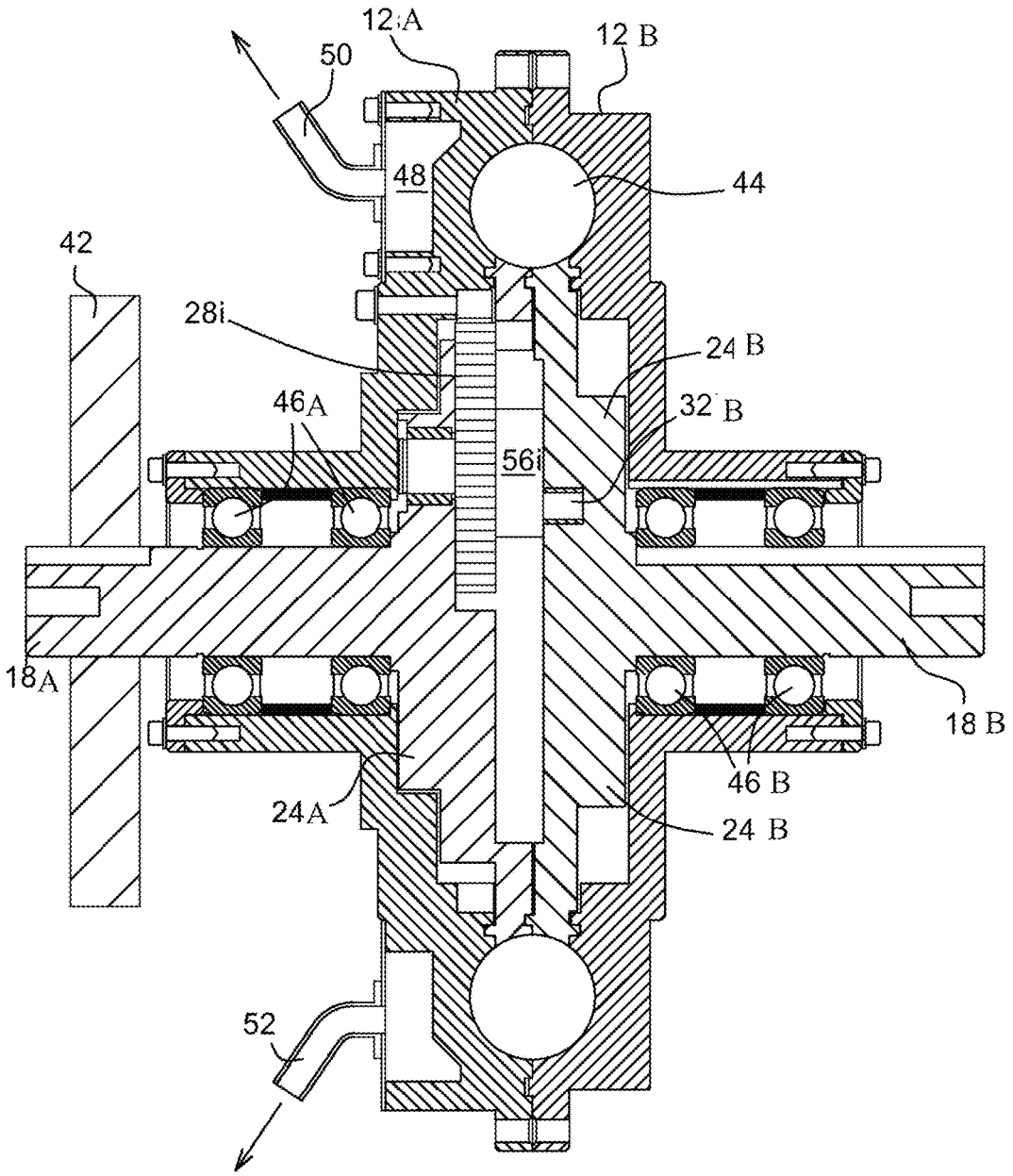
FIG. 4 is a sectional view of the round internal combustion engine of FIG. 1 being assembled.

FIG. 4 is a sectional view of the round internal combustion engine of FIG. 1 being assembled.

Shaft 18A, extending from shaft member 24A, rolls about housing member 12A via bearings 46A thereof. If shaft 18A is to be the output shaft, then shaft member 24A is the flywheel. In order to increase the functionality of shaft member 24A as the flywheel, a mass additive 42 may extend from shaft 18A. Shaft 18B, extending from shaft member 24B, rolls about housing member 12B via bearings 46B thereof.

A water cooling channel 48 disposed adjacent to toroidal combustion chamber 44, may cool toroidal combustion chamber 44 by flowing water between inlet/outlet 50 and 52.

Figure 5:
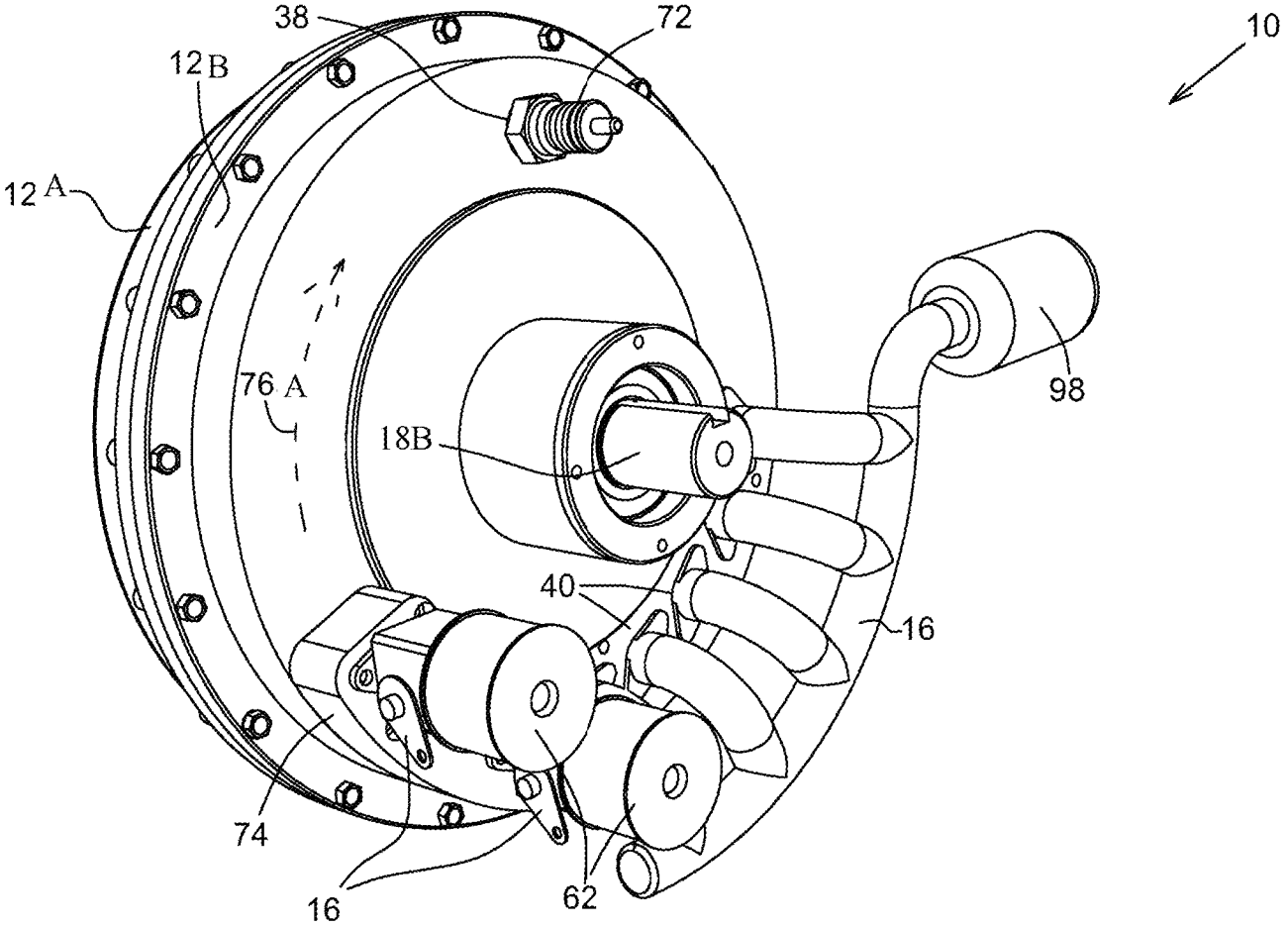
FIG. 5 is a perspective view of the round internal combustion engine of FIG. 1 being assembled and including accessories for operating the engine.

FIG. 5 is a perspective view of the round internal combustion engine of FIG. 1 being assembled and including accessories for operating the engine.

An intake manifold 62, which may include a carburetor is depicted connected to intake inlets 74 shown in FIG. 2. An exhaust manifold 16, ending with a silencer 98, is depicted connected to exhaust outlets 40, shown in FIG. 2. An ignition plug 72 is depicted connected to combustion aperture 38. For diesel a fuel injector may be connected to combustion aperture 38.

Pistons 26A1 and 26B1 travel along advancement direction 76A, being from intake manifold 62 towards combustion aperture 38, then towards exhaust manifold 16, and back again towards intake manifold 62.

Figure 6:
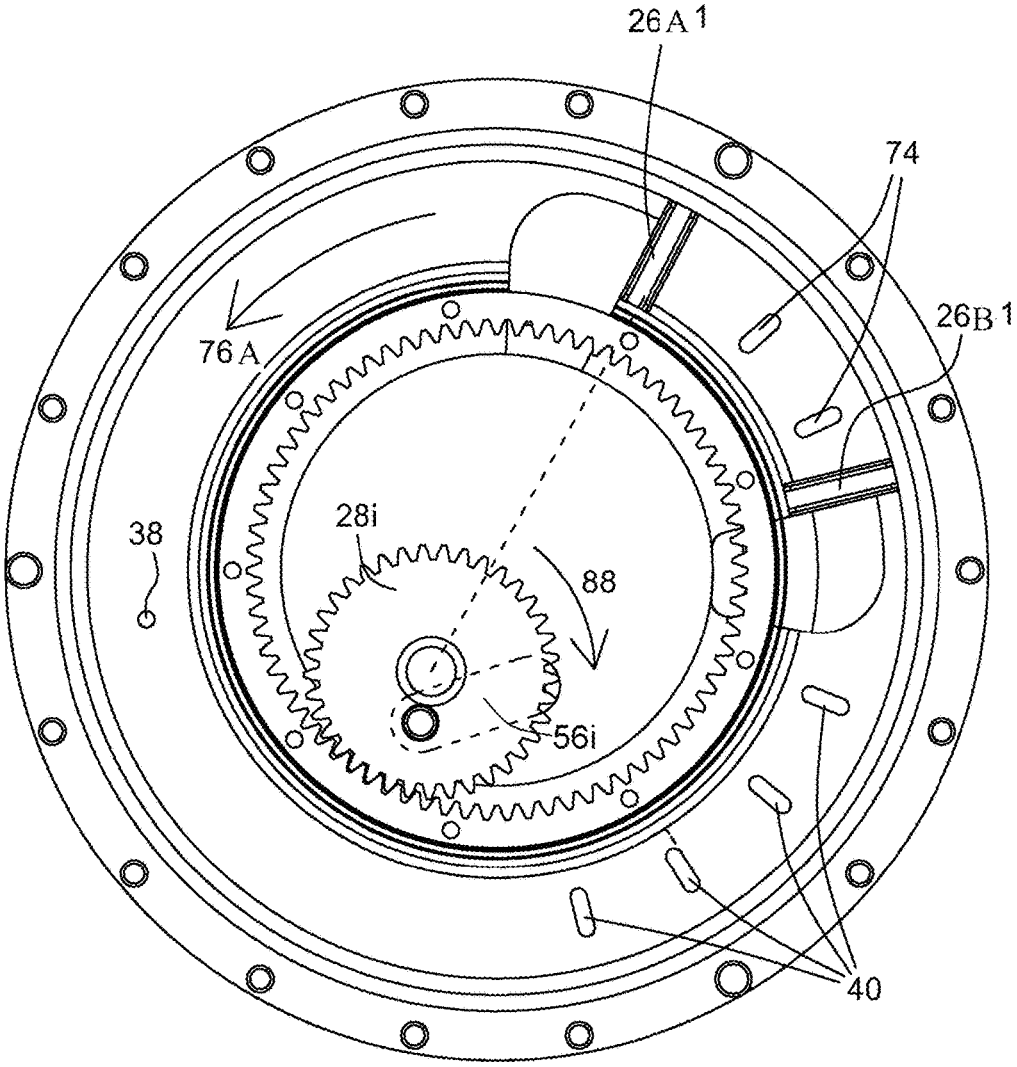
FIG. 6 is a sectional view of the round internal combustion engine of FIG. 1 at the Intake Stroke.

FIG. 6 is a sectional view of the round internal combustion engine of FIG. 1 at the Intake Stroke.

Intake manifold 62 shown in FIG. 5, supplies the air, for a diesel engine, or the fuel-air mixture through intake inlets 74, while the distance between pistons 26A1 and 26B1 is relatively large.

Figure 7:
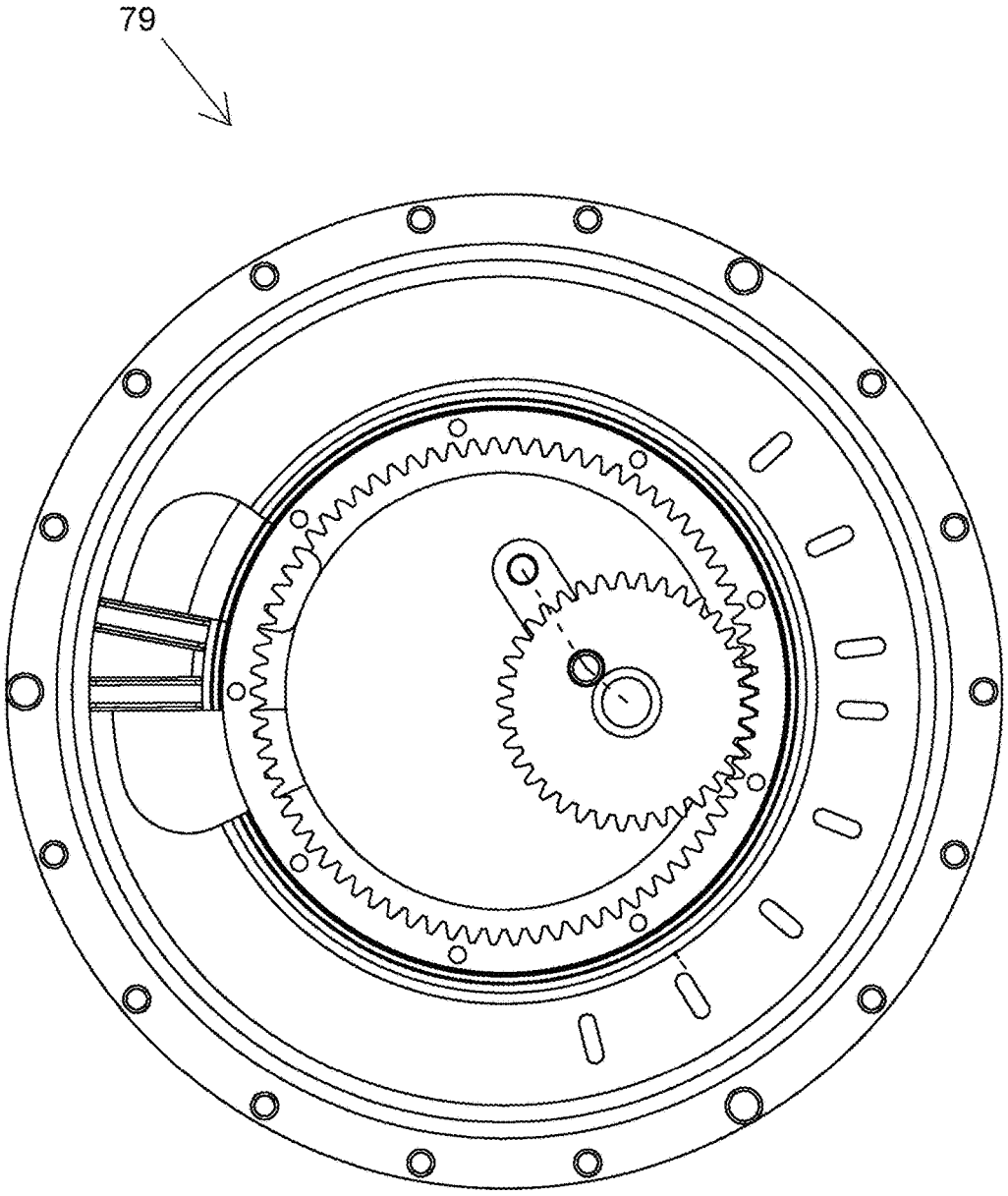
FIG. 7 is a sectional view of the round internal combustion engine of FIG. 1 at the position of the end of the Compression Stroke, prior to the combustion.

FIG. 7 is a sectional view of the round internal combustion engine of FIG. 1 at the position of the end of the Compression Stroke, prior to the combustion.

The position prior to the combustion is herein enumerated 79.

Figure 8:
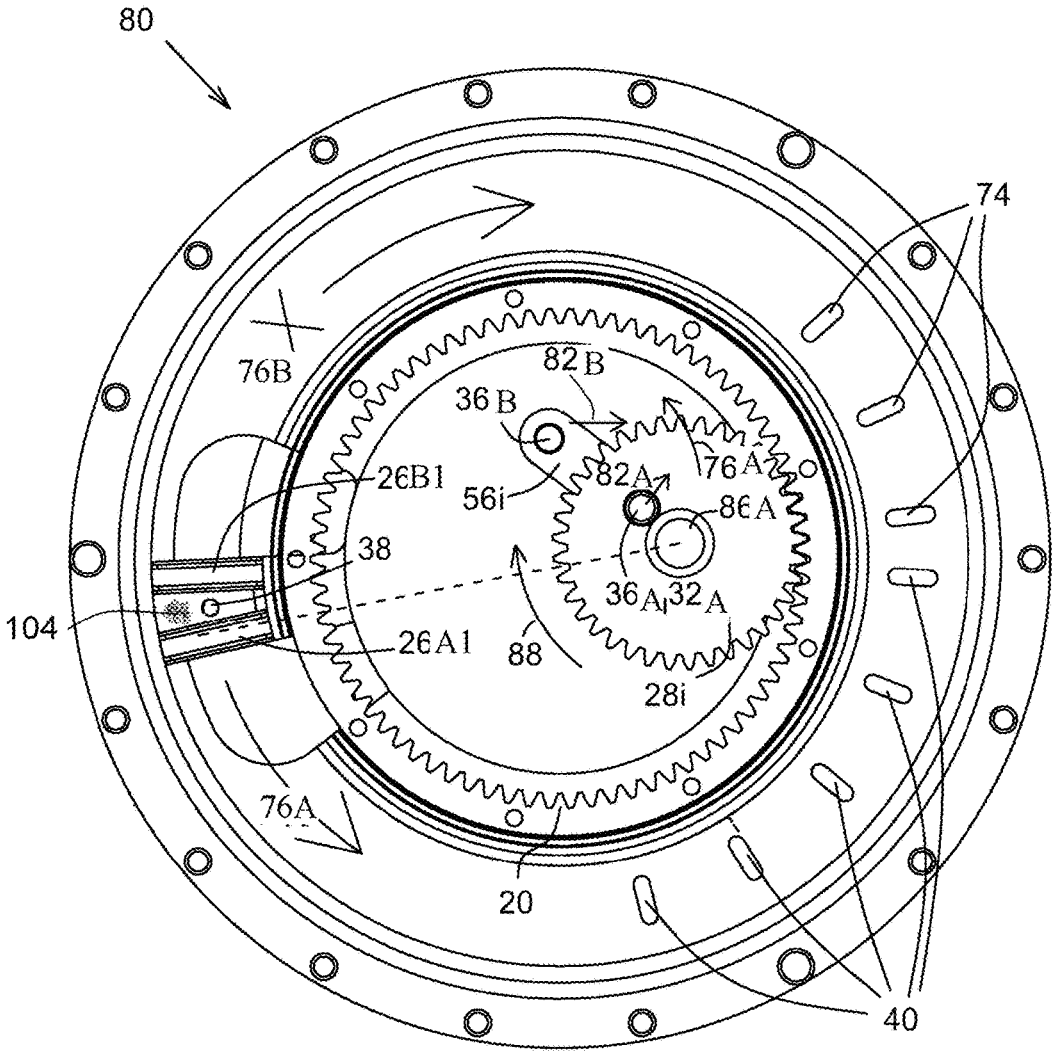
FIG. 8 is a sectional view of the round internal combustion engine of FIG. 1 at the end of the Compression Stroke, at the state of the combustion.

FIG. 8 is a sectional view of the round internal combustion engine of FIG. 1 at the end of the Compression Stroke, at the state of the combustion.

Positioning mechanism 60 is designed such that rotation of pistons 26A1 and 26B1 along advancement direction 76A, from the position of the Intake Stroke of FIG. 6, diminishes the distance between pistons 26A1 and 26B1, for compressing the confined air or the fuel-air mixture. This is the Compression Stroke.

The distance between pistons 26A1 and 26B1 is minimal once pistons 26A1 and 26B1 are disposed in front of combustion aperture 38. This position is herein named "combustion position", enumerated 80.

The combustion 104 of the fuel-air mixture produces the Power Stroke, for further rotating pistons 26A1 and 26B1 along advancement direction 76A.

Figure 9:
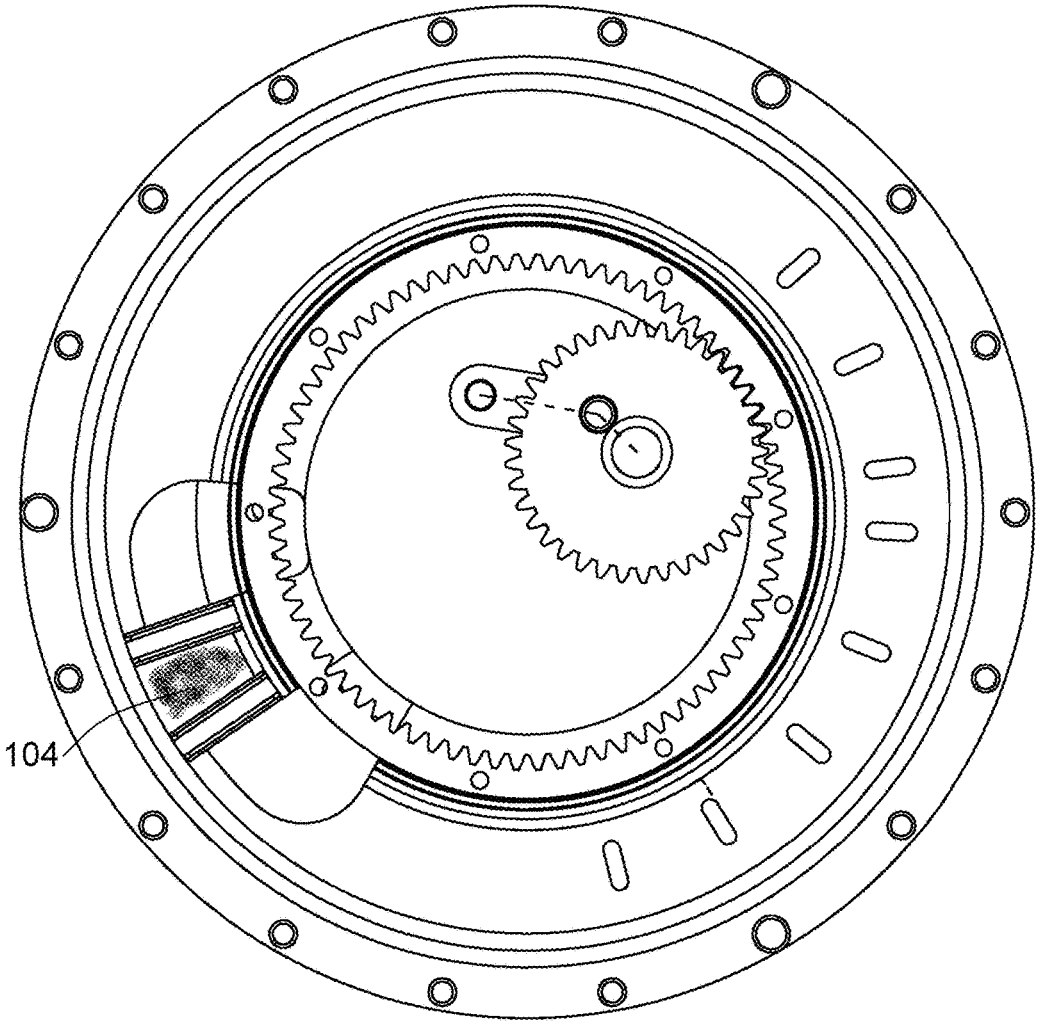
FIG. 9 is a sectional view of the round internal combustion engine of FIG. 1 at the beginning of the Power Stroke.

FIG. 9 is a sectional view of the round internal combustion engine of FIG. 1 at the beginning of the Power Stroke.

Figure 10:
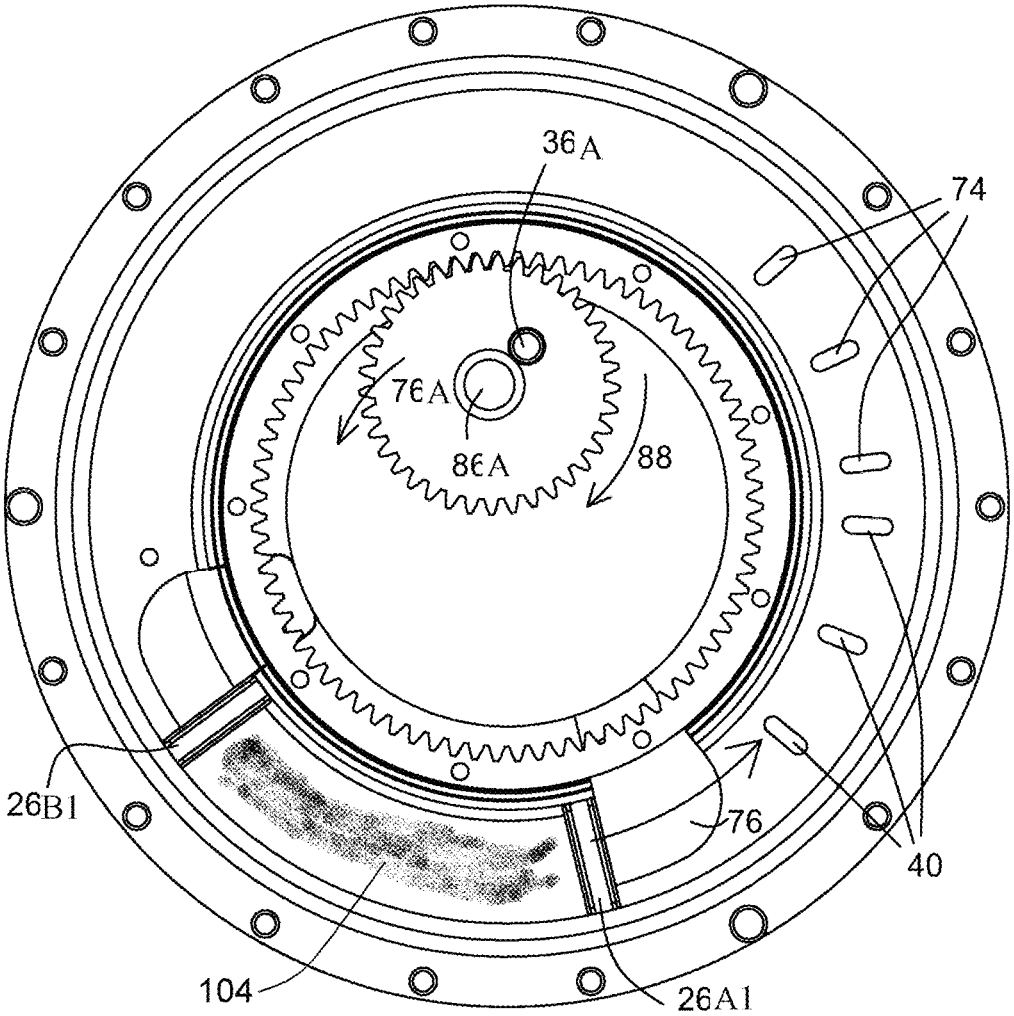
FIG. 10 is a sectional view of the round internal combustion engine of FIG. 1 at the end of the Power Stroke, and starting the Exhaust Stroke.

Positioning mechanism 60 is designed to enlarge the distance between pistons 26A1 and 26B1 during the rotation thereof along advancement direction 76A, after the combustion position 80, for allowing expansion of the gas, during the Power Stroke of FIGS. 9 and 10.

FIG. 10 is a sectional view of the round internal combustion engine of FIG. 1 at the end of the Power Stroke, and starting the Exhaust Stroke.

Positioning mechanism 60 is designed to diminish the distance between pistons 26A1 and 26B1 during the rotation thereof along advancement direction 76A, after the Power Stroke, for applying pressure on the gas, to exit through exhaust outlets 40.

Figure 11:
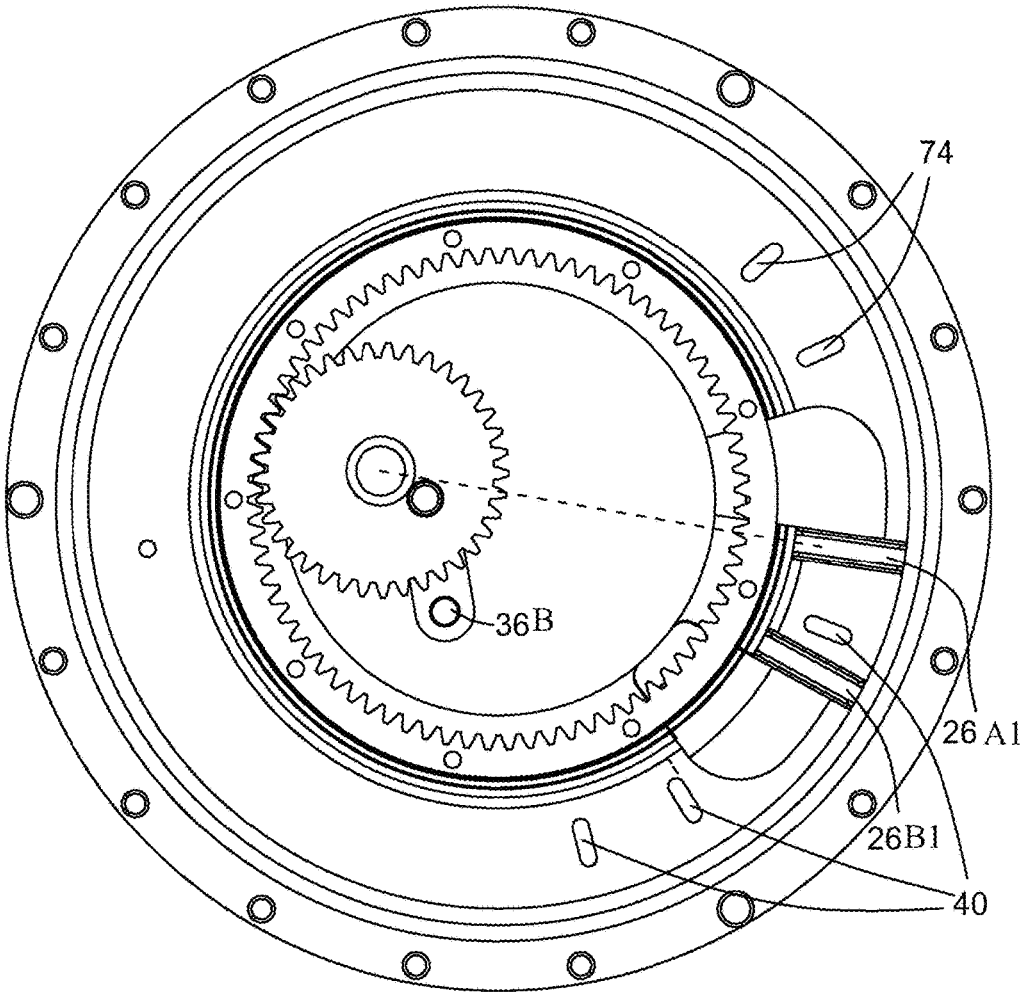
FIG. 11 is a sectional view of the round internal combustion engine of FIG. 1 at the end of the Exhaust Stroke.

FIG. 11 is a sectional view of the round internal combustion engine of FIG. 1 at the end of the Exhaust Stroke.

The distance between pistons 26A1 and 26B1 substantially is minimal at the end of the Exhaust Stroke once pistons 26A1 and 26B1 surround the last exhaust outlet 40.

Referring again to the combustion position 80 of FIG. 8, combustion 104 of the fuel-air mixture is intended to produce the Power Stroke, for rotating pistons 26A1 and 26B1 along advancement direction 76A.

Combustion 104, at combustion position 80, applies force not only on piston 26A1 to rotate along advancement direction 76A, but also on piston 26B1 to rotate back to position 79 of FIG. 7, along direction 76B being against advancement direction 76A. However, round internal combustion engine 10 is designed, as described herein, to allow, at this position of piston 26A1, easy motion of piston 26A1 along advancement direction 76A, and to disturb at this position of piston 26B1, the motion thereof along direction 76B.

The design of round internal combustion engine 10 to allow piston 26A1, at combustion position 80, easy motion of piston 26A1 along advancement direction 76A, and to disturb piston 26B1 from moving along direction 76B back to position 79, may be obtained by bearings 46B of shaft members 24B, being unidirectional bearings.

The design of round internal combustion engine 10 to allow piston 26A1, at combustion position 80, easy motion of piston 26A1 along advancement direction 76A, and to disturb piston 26B1 from moving along direction 76B back to position 79, is obtained by making shaft member 24A heavy, for constituting the flywheel enumerated 68, thus shaft member continues rotating along advancement direction 76A by the energy storage, and by making shaft member 24B lightweight, for making shaft member 24B be easily carried by shaft member 24A.

The design of round internal combustion engine 10 to allow piston 26A1, at combustion position 80, easy motion of piston 26A1 along advancement direction 76A, and to disturb piston 26B1 from moving along direction 76B back to position 79, is further obtained by designing positioning mechanism 60 to do so, as described herein.

Referring to FIG. 1, positioning mechanism 60 is designed to carry gear 28*i* along advancement direction 76A, by shaft member 24A, being connected to piston 26A1, upon being pressurized by the combustion 104 towards advancement direction 76A. Positioning mechanism 60 is further designed to rotate gear 28*i*, together with eccentric anchor 36A thereof along direction 88.

Referring to FIG. 8, positioning mechanism 60 is further designed to draw, by the eccentric rotation of eccentric anchor 36A along direction 88, rod-end 32A of connecting-rod 56*i*, being anchored to eccentric anchor 36A of gear 28*i*, towards the direction enumerated 82A, which is perpendicular to connecting-rod 56*i*.

Drawing of rod-end 32A of connecting-rod 56*i* requires the minimal force while being pushed perpendicular to connecting-rod 56*i*. Thus, the drawing of rod-end 32A in direction 82A, being perpendicular to connecting-rod 56*i*, provides the character of positioning mechanism 60 of allowing easy motion of piston 26A1 along advancement direction 76A once being disposed at combustion position 80.

Referring again to FIG. 1, positioning mechanism 60 is designed to rotate eccentric anchor 36B of shaft member 24B, along direction 76B, by pressure of the combustion applied on piston 26B1 connected to shaft member 24B.

Referring again to FIG. 1, rotation of eccentric anchor 36B of shaft member 24B, along direction 76B draws rod-end 32B of connecting-rod 56*i*, being anchored to eccentric anchor 36B, along direction 82A, being direction 76B at the rotational position of rod-end 32B.

Direction 82A is substantially parallel to connecting-rod 56*i*, thus positioning mechanism 60 is designed to draw rod-end 32B of connecting-rod 56*i* parallel to connecting-rod 56*i*.

Drawing of rod-end 32B of connecting-rod 56*i* requires maximal force while being pushed parallel to connecting-rod 56*i*. Thus, the drawing of rod-end 32B in direction 82B, being parallel to connecting-rod 56*i*, provides the character of substantially disallowing motion of piston 26B1 along direction 76B back to position 79, once being disposed at combustion position 80.

Thus, the design of positioning mechanism 60 to allow piston 26A1, at combustion position 80, easy motion of piston 26A1 along advancement direction 76A, and to disturb piston 26B1 from moving along direction 76B is obtained by the disposition of connecting-rod 56*i* being directed towards the center 86A of eccentric gear 28*i*. This since at this position, rod-end 32A is directed to direction 82A, being perpendicular to connecting-rod 56; and rod-end 32B is directed to direction 82B, being parallel to connecting-rod 56*i*.

Figure 12:
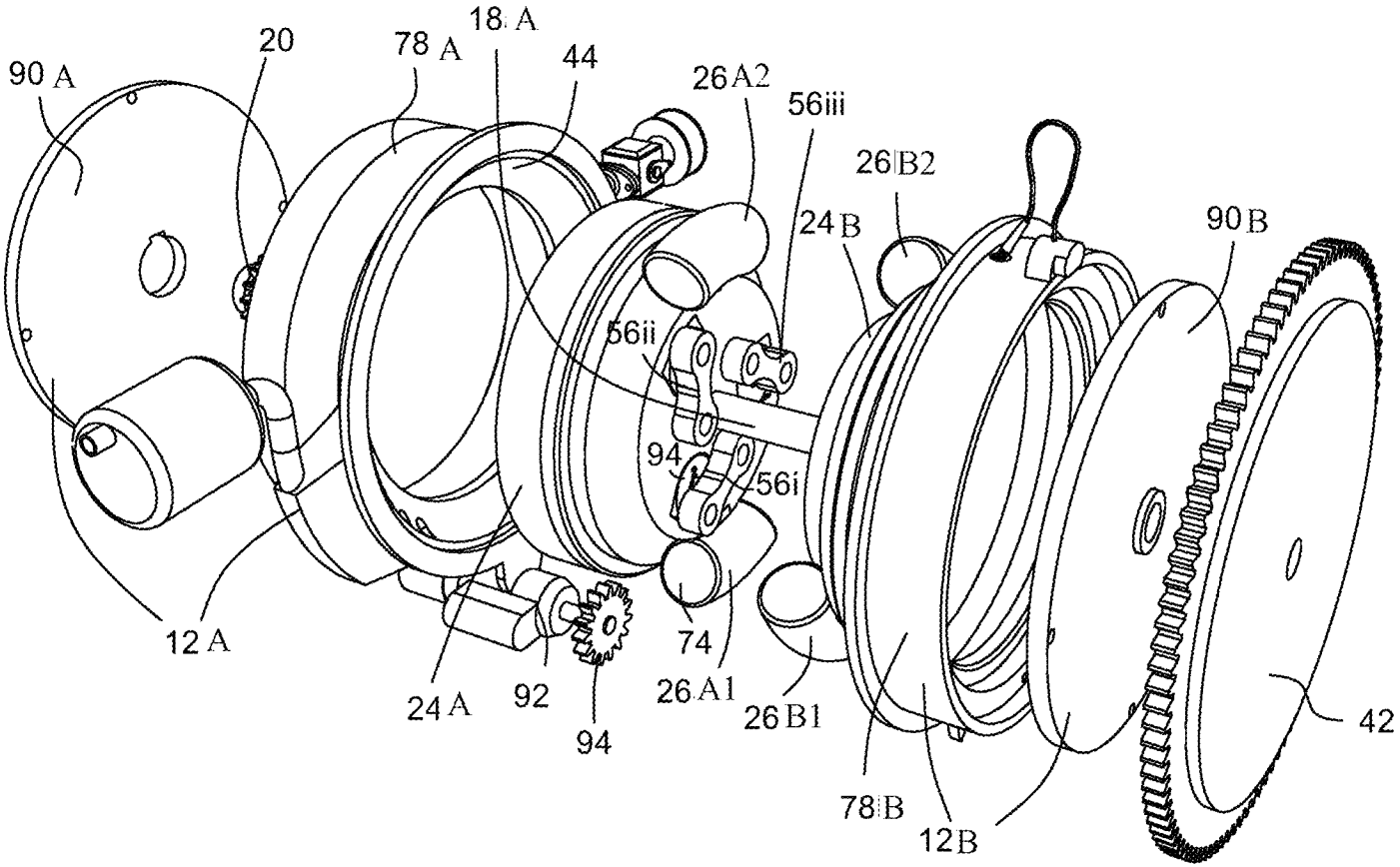
FIG. 12 is an exploded view of a round internal combustion engine, according to another embodiment of the present invention.

FIG. 12 is an exploded view of a round internal combustion engine, according to another embodiment of the present invention.

According to this embodiment round internal combustion engine 10 as well includes stationary housing members 12A and 12B, forming together toroidal combustion chamber 44 in between. Stationary housing member 12A includes a peripheral member 78A and a covering member 90A; and stationary housing member 12B includes a peripheral member 78B and a covering member 90B.

Shaft members 24A and 24B as well rotate between stationary housing members 12A and 12B. Only one of the shaft members is a flywheel. According to the example of FIG. 12 shaft member 24A is the flywheel, since, it is connected through the shaft 18A thereof to a mass additive 42.

At least one piston is connected to each shaft member. According to the embodiment of FIG. 12, pistons 26A1 and 26A2 are connected to shaft member 24A; and pistons 26B1 and 26B2 are connected to shaft member 24B. Thus, combustion between pistons 26A1 and 26B1 produces power, and combustion between pistons 26A2 and 26B2 as well produces power.

Each of connecting-rods 56*i*, 56*ii*, and 56*iii* allows one of the shaft members to directly pull the other shaft member thereafter.

Figure 13:
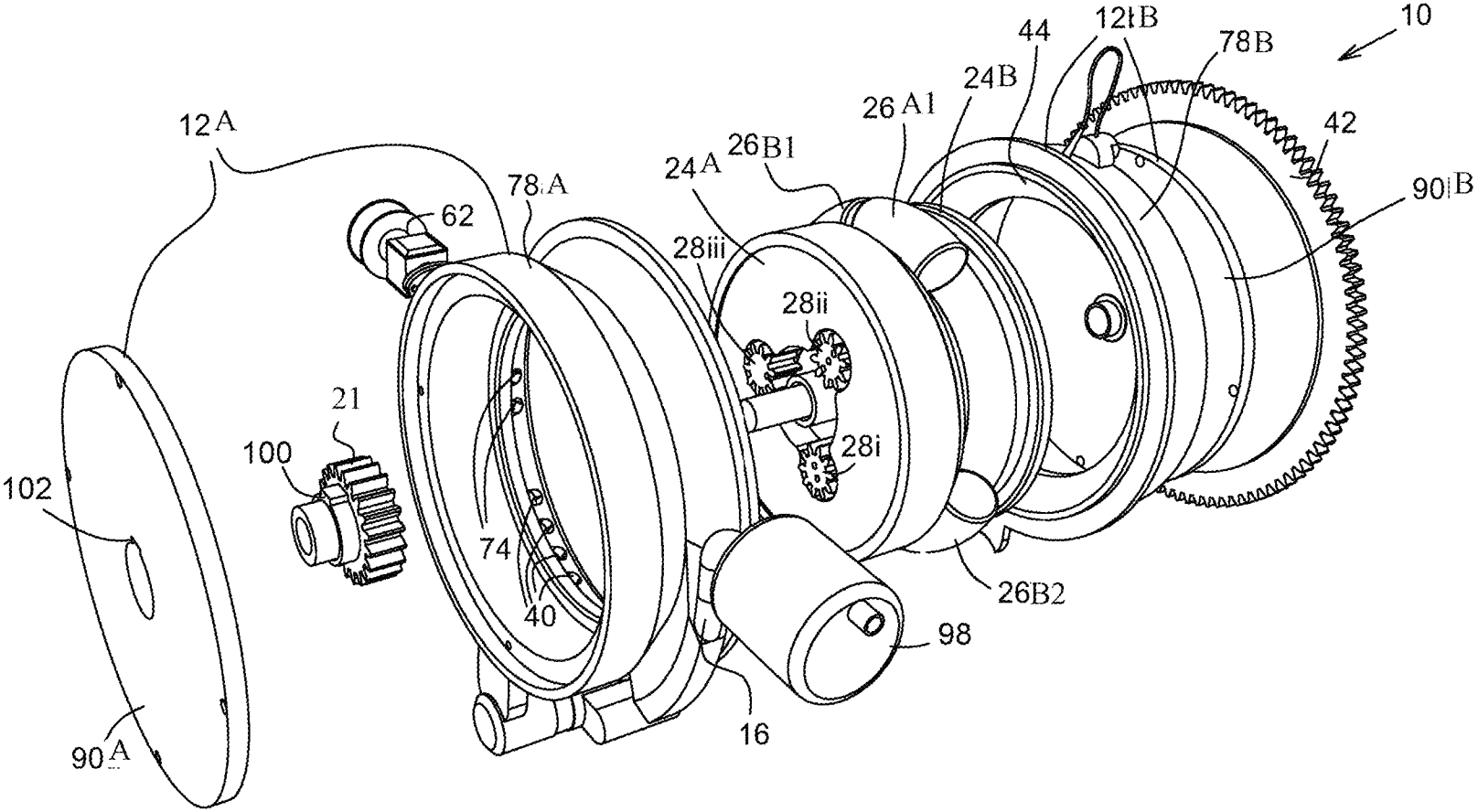
FIG. 13 is an exploded view of the round internal combustion engine of FIG. 12 from another angle of view.

FIG. 13 is an exploded view of the round internal combustion engine of FIG. 12 from another angle of view.

At least one gear 28*i* is disposed within at least one eccentric area of shaft member 24A. According to this embodiment, gears 28*i*, 28*ii*, and 28*iii* are disposed each in another eccentric area of shaft member 24A.

Each of gears 28*i*, 28*ii*, and 28*iii* is meshed with a stationary gear 21. Gear 21 is rigidly fixed to stationary housing member 12A. According to one example, the rigid fixing is applied by a protrusion 100 extending from gear 21, inserted into a complementary depression 102 in cover 90A of stationary housing member 12A.

Gear 21 of FIG. 13 is similar to gear 20 of FIG. 1 in that both are stationary. However, in contrast to gear 20 of FIG. 1 surrounding the trajectory of gear 28*i*, gear 21 of FIG. 13 is disposed within the trajectory of gear 28*i*, and as well within the trajectory of gears 28*ii* and 28*iii*, thus wheels 28*i*, 28*ii*, and 28*iii* rotate outside stationary gear 21.

Figure 14:
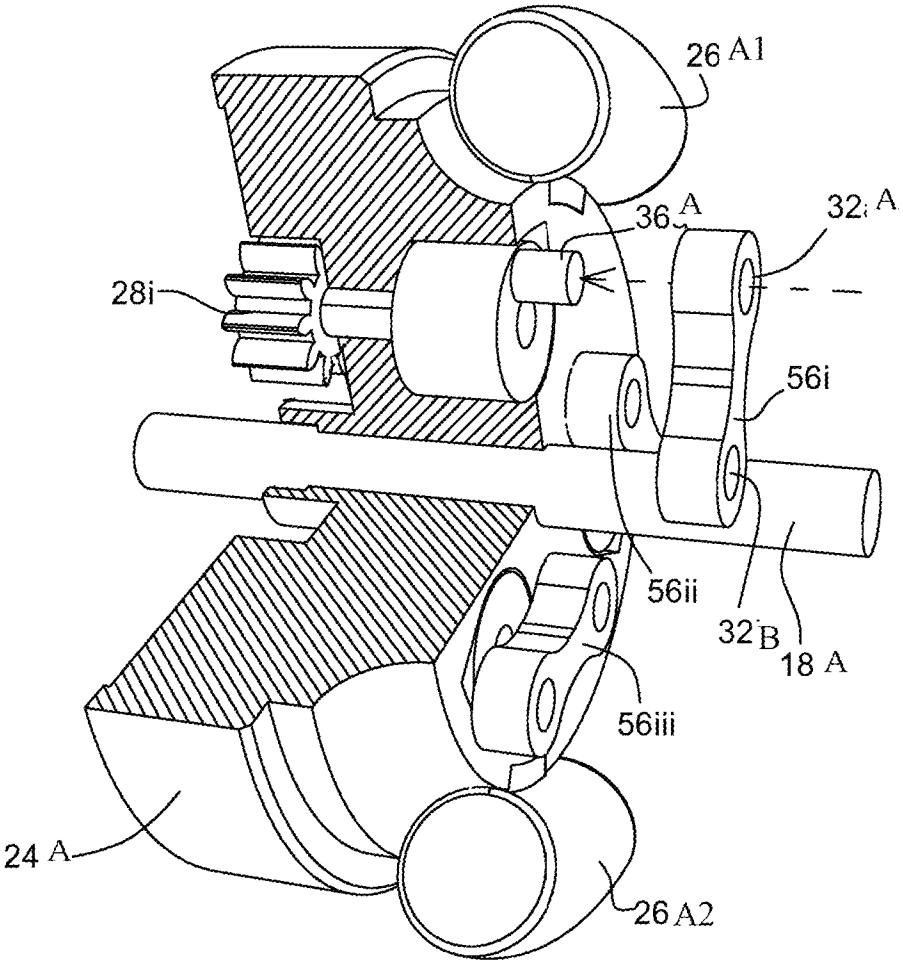
FIG. 14 is a partial exploded view of the round internal combustion engine of FIG. 12 for showing the connecting-rods of FIG. 12 and the gears of FIG. 13 communicating one with the other.

FIG. 14 is a partial exploded view of the round internal combustion engine of FIG. 12 for showing the connecting-rods of FIG. 12 and the gears of FIG. 13 communicating one with the other.

End 32A of connecting-rod 56*i* is anchored to eccentric anchor 36A of gear 28*i* within shaft member 24A; and end 32B of connecting-rod 56*i* is anchored to anchor 36B of shaft member 24B.

In the same manner, even though not depicted in the figure, end 32A of connecting-rod 56*ii* is anchored to eccentric anchor 36A of gear 28*ii* within shaft member 24A; and end 32B of connecting-rod 56*ii* is anchored to anchor 36B of shaft member 24B. In the same manner, end 32A of connecting-rod 56*iii* is anchored to eccentric anchor 36A of gear 28*iii* within shaft member 24A; and end 32B of connecting-rod 56*iii* is anchored to anchor 36B of shaft member 24B.

Figure 15:
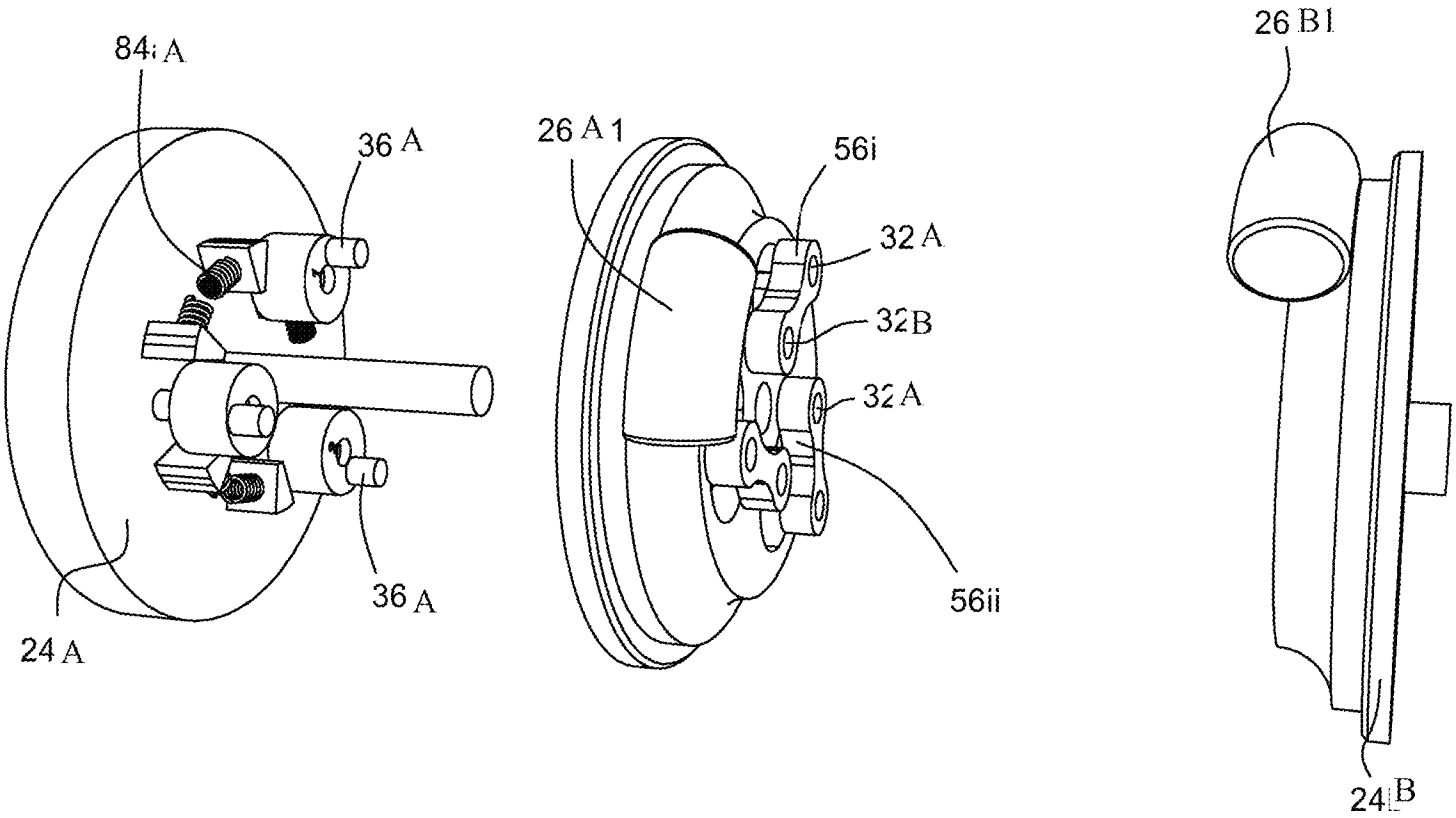
FIG. 15 is a partial exploded view of the round internal combustion engine of FIG. 12 for showing the connecting-rods of FIG. 12 and the gears of FIG. 13 communicating one with the other via a springy element.

FIG. 15 is a partial exploded view of the round internal combustion engine of FIG. 12 for showing the connecting-rods of FIG. 12 and the gears of FIG. 13 communicating one with the other via a springy element.

In order to further soften the momentary forces of shaft members 24A and 24B one upon the other, applied by the combustion, confined between pistons 26A1 and 26B1, piston 26A1 may be connected to shaft member 24A via a springy element 84A.

End 32A of connecting-rod 56*i* is anchored to eccentric anchor 36A; and anchor 36A is connected to gear 28*i* within shaft member 24A, through springy element 28*i*.

Figure 16:
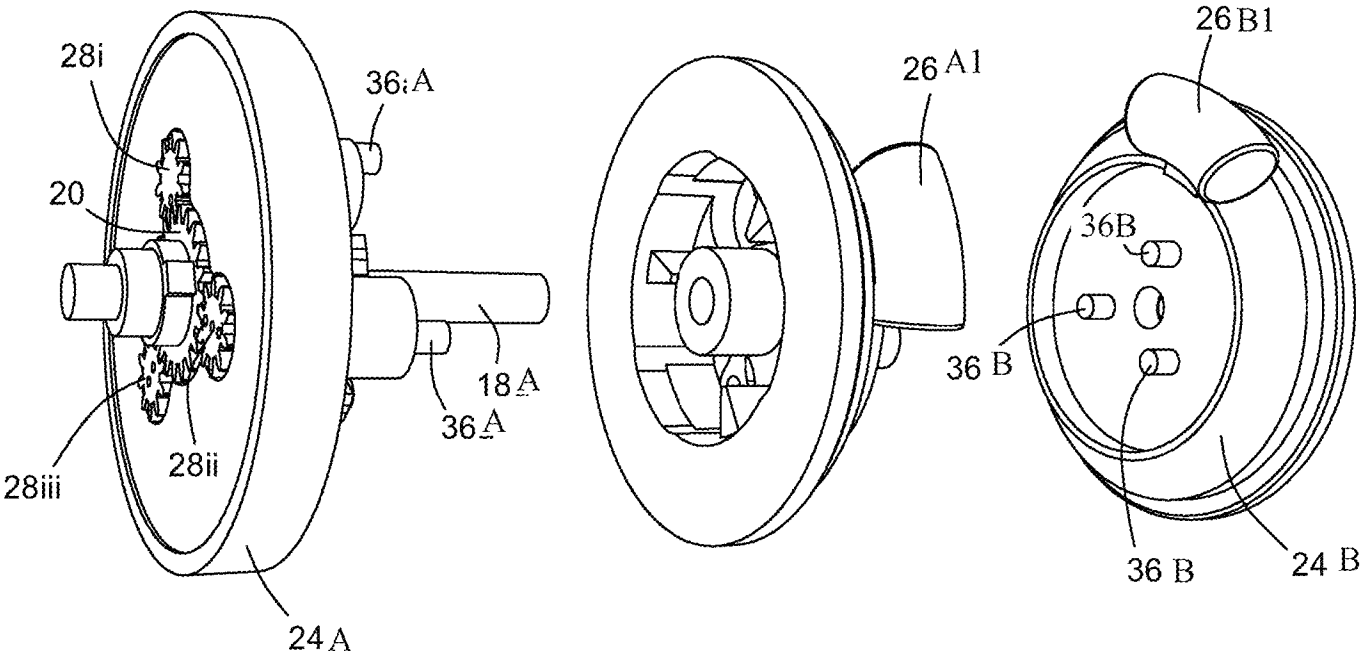
FIG. 16 is the exploded view of FIG. 15 from another angle of view.

FIG. 16 is the exploded view of FIG. 15 from another angle of view.

End 32B of connecting-rod 56*i* is anchored to anchor 36B of shaft member 24B.

Figure 17:
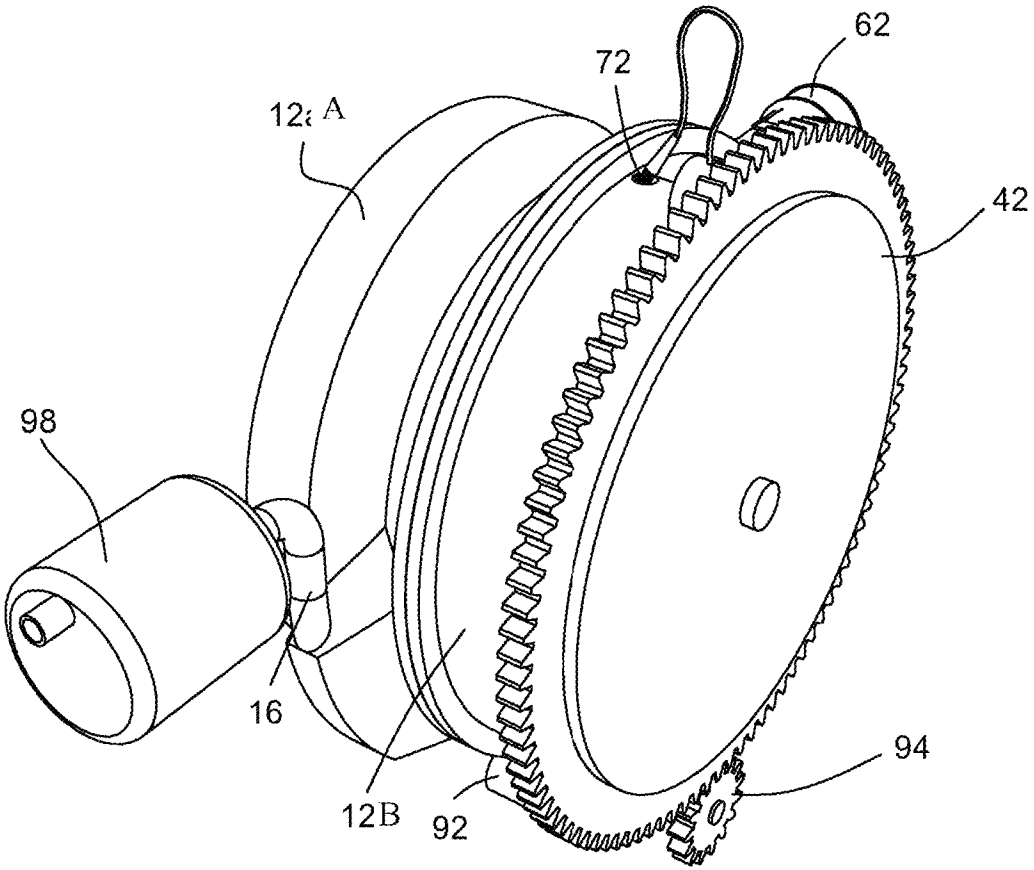
FIG. 17 is a perspective view of the round internal combustion engine of FIG. 12 being assembled and including accessories for operating the engine.

FIG. 17 is a perspective view of the round internal combustion engine of FIG. 12 being assembled and including accessories for operating the engine.

An electric motor 92 may rotate, through a gear 94 thereof, shaft member 24A through mass additive 42, so as to initiate the operation of round internal combustion engine 10 under its own power.

In the figures and/or description herein, the following reference numerals (Reference Signs List) have been mentioned:

numeral 10 denotes a round internal combustion engine according to one embodiment of the present invention;

numerals 12A and 12B denote stationary housing members, forming together a toroidal combustion chamber in between;

numeral 16 denotes an exhaust manifold, for receiving the exhaust from exhaust outlet;

numerals 18A and 18B denote shafts of the engine, one having a relatively constant angular velocity, and the other accelerating and deaccelerating back and forth; each shaft extends from a shaft member;

numeral 20 denotes a stationary gear, being fixed to one of the housing members;

numerals 24A and 24B denote shaft members, from which the shafts extend; only one of the shaft functions as a flywheel;

numerals 26A1 and 26A1 denotes pistons connected to shaft member 24A;

numerals 26B2 and 26B2 denotes pistons connected to shaft member 24B;

numerals 28*i*, 28*ii* and 28*iii* denote satellite gears;

numerals 28*i*A and 28*i*B denote secondary gears, constituting satellite gear 28*i*, according to one embodiment;

numerals 32A and 32B denote two ends of the connecting-rod, each being connected to another shaft member;

numerals 36A and 36B denote eccentric anchors, each for one end of the connecting-rod; each eccentric anchor is part of one of the shaft members;

numeral 38 denotes an aperture, for producing therethrough combustion; according to one embodiment this aperture is for an ignition plug;

numeral 40 denotes an exhaust outlet;

numeral 42 denotes a mass additive for the flywheel;

numeral 44 denotes a toroidal combustion chamber, formed by the stationary housing members;

numerals 46A and 46B denote bearing, one for each shaft;

numeral 48 denotes a water cooling channel;

numeral 50 denotes an inlet or an outlet of the water cooling channel;

numeral 52 denotes an inlet or an outlet of the water cooling channel;

numeral 54 denotes a bolt;

numerals 56*i*, 56*ii* and 56*iii* denote connecting-rods, for directly connecting the shaft members one to the other;

numeral 58 denotes an area in one of the shaft members, in a satellite gear is disposed;

numeral 60 denotes a positioning mechanism, for determining the position between the shaft members;

numeral 62 denotes an intake manifold, for inserting the fuel;

numeral 64 denotes a hole or a depression in the shaft member which is not the flywheel; the hole or the depression for reducing weight;

numerals 66A and 66B denote rings, each extending from one of the shaft members, for completing the sealing of the toroidal combustion chamber;

numeral 68 denotes a flywheel, being one of the shaft members;

numeral 72 denotes an ignition plug;

numeral 74 denotes an intake inlet;

numeral 76A denotes the rotary direction of the rotation of the output shaft and the other shaft;

numeral 76B denotes a rotary direction which is opposite to the rotary direction of the output shaft and the other shaft; the combustion presses also to this direction; however the shafts do not advance to this direction;

numerals 78A and 78B denote peripheral members, one of each stationary housing member;

numeral 79 denotes the position of the pistons and of the components of the positioning mechanism at the end of the Compression Stroke, prior to the combustion;

numeral 80 denotes the position of the pistons and of the components of the positioning mechanism once the combustion occurs;

numeral 82A denotes the direction of the movement of the eccentric anchor of the satellite gear;

numeral 82B denotes the direction of the movement of the eccentric anchor of the shaft member which does not contain the satellite gear;

numerals 84A and 84B denotes springy elements, each for softening the position of a piston in relation to another shaft member;

numeral 84A denotes a springy element for softening the position of one of the pistons in relation to the shaft member 24A thereof;

numeral 84B denotes a springy element for softening the position of one of the pistons in relation to the shaft member 24B thereof;

numeral 86A denotes the axle of the eccentric gear;

numeral 88 denotes the rotary direction of the rotation of the satellite gear;

numerals 90A and 90B denote covers, one of each stationary housing member;

numeral 92 denotes an electric motor;

numeral 94 denotes a gear extending from the electric motor of the starter of the vehicle;

numeral 96 denotes an opening in the shaft member containing satellite gear, for meshing the satellite gear with a stationary gear;

numeral 98 denotes a silencer;

numeral 100 denotes a protrusion extending from the stationary gear;

numeral 102 denotes a depression in the cover of the stationary housing member;

numeral 104 denotes the combustion;

numeral 106 denotes a spring disposed between the secondary gears;

numerals 108A and 108B, each denotes a depression in one secondary gear;

numeral 110 denotes an axle of one of the secondary gears;

numerals 112A and 112B each denotes a cog of one secondary gear; and numeral 114 denotes a niche of one of the secondary gears, for housing the axle of the other secondary gear;

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

What is claimed is:

1. A round internal combustion engine (10) comprising:

a stationary toroidal combustion chamber (44);

a first (24A) and a second (24B) shaft member, each for connecting thereof to at least one piston (26A1, 26A2, 26B1, 26B2), disposed within said stationary toroidal combustion chamber (44); and a positioning mechanism (60), for changing angular positioning and velocity between said first (24A) and second (24B) shaft members, for increasing and decreasing a distance between said pistons (26A1, 26A2, 26B1, 26B2) of said shaft members (24A, 24B), said positioning mechanism (60) comprising:

a) at least one rotatable wheel (28*i*, 28*ii*, 28*iii*) disposed eccentrically (58) within said first shaft member (24A); and b) at least one rotatable connecting-rod (56*i*, 56*ii*, 56*iii*) disposed between said first (24A) and second (24B) shaft members, for directly connecting an eccentric anchor (36A) of said at least one rotatable wheel (28*i*, 28*ii*, 28*iii*) to an eccentric anchor (36B) of said second shaft member (24B), thereby stresses between said first (24A) and second (24B) shaft members, applied by said changing of the angular positioning and of the angular velocity between said first (24A) and second (24B) shaft members, are absorbed by said at least one rotatable connecting-rod (56*i*, 56*ii*, 56*iii*) rather than by gear meshing.

2. A round internal combustion engine (10) according to claim 1, wherein one of said shaft members (24A, 24B) comprises significantly larger mass that the other shaft member (24A, 24B), thereby the angular velocity of said one of said shaft members (24A, 24B) is substantially constant, and the angular velocity of said other shaft member (24A, 24B) is conveniently changeable by said changing of the angular positioning and of the angular velocity between said first (24A) and second (24B) shaft members.

3. A round internal combustion engine (10) according to claim 2, wherein the shaft member (24A, 24B) comprising said larger mass comprises said first shaft member (24A), thereby utilizing said at least one rotatable wheel (28*i*, 28*ii*, 28*iii*) for enlarging said mass.

4. A round internal combustion engine (10) according to claim 1, further comprising:

a springy element (84A, 84B), for connecting at least one of said shaft members (24A, 24B) to the piston (26A1, 26A2, 26B1, 26B2) thereof, thereby softening momentary forces of said shaft members (24A, 24B) one upon the other.

5. A round internal combustion engine (10) according to claim 1, wherein said at least one rotatable wheel (28*i*, 28*ii*, 28*iii*) comprises at least one gear, and wherein said round internal combustion engine (10) further comprises:

a first stationary gear (20) meshed with said at least one rotatable wheel (28*i*, 28*ii*, 28*iii*), for rotating said at least one rotatable wheel (28*i*, 28*ii*, 28*iii*) about itself upon said rotation of said first shaft member (24A).

6. A round internal combustion engine (10) according to claim 5, wherein said at least one gear (28*i*, 28*ii*, 28*iii*) being meshed with said first stationary gear (20), comprises:

a first secondary gear (28*i*A) meshed with said first stationary gear (20);

a second secondary gear (28*i*B) meshed said first stationary gear (20); and a spring (106) disposed between said first (28*i*A) and second (28*i*B) secondary gears, for angularly pressing one secondary gear against the other, thereby said spring (106) presses each cog (112A) of said first secondary gear (28*i*A) towards one side (116A) of a meshed cog of said first stationary gear (20), and presses each cog (112B) of said second secondary gear (28*i*B) towards a counter side (116B) of the meshed cog of said first stationary gear (20), thereby said spring (106) substantially avoids knocking of the cogs one against the other, in spite of said changing of the angular velocity between said first (24A) and second (24B) shaft members.

7. A round internal combustion engine (10) according to claim 5, wherein said first stationary gear (20) comprises a peripheral gear (20), for allowing said at least one rotatable wheel (28*i*, 28*ii*, 28*iii*) to rotate inside said first stationary gear (20).

8. A round internal combustion engine (10) according to claim 1, wherein said stationary toroidal combustion chamber (44) comprises a combustion aperture (38) disposed where (80) the distance between said at least one piston (26A1, 26A2, 26B1, 26B2) of said first (24A) and of second (24B) shaft member is substantially minimal.

9. A round internal combustion engine (10) according to claim 1, wherein at a position that the distance between said at least one piston (26A1, 26A2, 26B1, 26B2) of said first (24A) and of second (24B) shaft member is minimal (80), said positioning mechanism (60) is characterized in braking one of the shaft members (24B) against pressure applied by combustion on the piston thereof (26B1) against (76B) an advancement direction (76A).

10. A round internal combustion engine (10) according to claim 9, wherein said character of said positioning mechanism of braking one of the shaft members (24B) against the pressure applied by the combustion on the piston thereof (26B1) against (76B) the advancement direction (76A), comprises:

disposition of said at least one rotatable connecting-rod (56*i*, 56*ii*, 56*iii*) being directed substantially towards a center (86A) of said at least one rotatable wheel (28*i*, 28*ii*, 28*iii*) at the position that the distance between said at least one piston (26A1, 26A2, 26B1, 26B2) of said first (24A) and of second (24B) shaft member is substantially minimal (80), thereby pressure applied by said combustion towards said advancement direction (76A) presses said at least one rotatable connecting-rod (56*i*, 56*ii*, 56*iii*) perpendicular thereto, and pressure applied by said combustion against (76B) said advancement direction (76A) presses said at least one rotatable connecting-rod (56*i*, 56*ii*, 56*iii*) parallel thereto.

11. A round internal combustion engine (10) according to claim 1, wherein said at least one rotatable wheel (28*i*, 28*ii*, 28*iii*) comprises at least one gear, and wherein said round internal combustion engine (10) further comprises:

a second stationary gear (21) meshed with said at least one rotatable wheel (28*i*, 28*ii*, 28*iii*), for rotating said at least one rotatable wheel (28*i*, 28*ii*, 28*iii*) about itself upon said rotation of said first shaft member (24A), wherein said second stationary gear (21) comprises a wheel, for allowing said at least one rotatable wheel (28*i*, 28*ii*, 28*iii*) to rotate outside said second stationary gear (21).

* * * * *